US007779665B2

(12) United States Patent
Rogers et al.

(10) Patent No.: US 7,779,665 B2
(45) Date of Patent: Aug. 24, 2010

(54) PRESS BRAKE DIE HOLDER TECHNOLOGY

(75) Inventors: Bryan L. Rogers, Forest Lake, MN (US); Thomas S. Duppong, Lake Elmo, MN (US); Brian J. Lee, Elk River, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 968 days.

(21) Appl. No.: 11/554,188

(22) Filed: Oct. 30, 2006

(65) Prior Publication Data

US 2008/0098793 A1 May 1, 2008

(51) Int. Cl.
*B21D 5/02* (2006.01)
*B21D 37/04* (2006.01)

(52) U.S. Cl. ..... 72/482.1; 72/481.1; 72/482.2

(58) Field of Classification Search ..... 72/481.1, 72/481.2, 482.1, 482.2, 482.6
See application file for complete search history.

(56) References Cited

U.S. PATENT DOCUMENTS

| | | | | |
|---|---|---|---|---|
| 1,462,556 | A | 7/1923 | Kropp | |
| 2,364,401 | A | 12/1944 | Stellin | |
| 2,378,806 | A | 6/1945 | Stellin | |
| 2,380,343 | A | 7/1945 | Stellin | |
| 3,535,967 | A | 10/1970 | Whistler | |
| 4,315,425 | A * | 2/1982 | Zbornik et al. | 72/481.2 |
| 4,486,941 | A | 12/1984 | Scott | |
| 4,552,050 | A | 11/1985 | Grefe | |
| 4,570,327 | A | 2/1986 | Klingel | |
| 4,612,796 | A | 9/1986 | Smyth, Jr. | |
| 4,627,321 | A | 12/1986 | Moore | |
| 4,718,161 | A | 1/1988 | Pfister | |
| 4,736,612 | A | 4/1988 | Russell | |
| 4,779,329 | A | 10/1988 | Nordquist | |
| 4,787,237 | A | 11/1988 | Houston | |
| 4,790,173 | A | 12/1988 | Boutcher | |
| 4,895,014 | A | 1/1990 | Houston | |
| 4,898,015 | A | 2/1990 | Houston | |
| 5,042,352 | A | 8/1991 | Lux | |
| 5,146,774 | A | 9/1992 | Smith | |
| 5,295,938 | A | 3/1994 | Jilsen | |
| 5,635,223 | A | 6/1997 | Korsch | |
| 5,843,488 | A | 12/1998 | Korsch | |
| 5,901,628 | A | 5/1999 | Sakamoto | |

(Continued)

FOREIGN PATENT DOCUMENTS

| | | | |
|---|---|---|---|
| DE | 102005051368 | A1 | 4/2006 |

(Continued)

OTHER PUBLICATIONS

International Search Report, completed on Apr. 28, 2008 and mailed on May 9, 2008, pp. 1-7.

(Continued)

*Primary Examiner*—David B Jones
(74) *Attorney, Agent, or Firm*—Fredrikson & Byron, P.A.

(57) ABSTRACT

A press brake die holder for holding a press brake die having an upper, work-contacting portion and a lower, elongated tang. The die holder has an elongated body with a channel bounded by confronting walls, the channel being configured to receive the tang of the press brake die.

27 Claims, 27 Drawing Sheets

U.S. PATENT DOCUMENTS

| | | | | | |
|---|---|---|---|---|---|
| 6,003,360 | A * | 12/1999 | Runk et al. | ..... | 72/482.2 |
| 6,044,742 | A | 4/2000 | Sakamoto | | |
| 6,119,503 | A | 9/2000 | Peloquin | | |
| 6,151,951 | A * | 11/2000 | Kawano | ..... | 72/481.2 |
| 6,244,800 | B1 | 6/2001 | Studanski | | |
| 6,446,485 | B1 * | 9/2002 | Tarasconi | ..... | 72/481.1 |
| 6,499,330 | B1 | 12/2002 | Pelech | | |
| 6,516,649 | B1 | 2/2003 | Mika | | |
| 6,606,896 | B2 * | 8/2003 | Tarasconi | ..... | 72/482.3 |
| 6,826,946 | B2 | 12/2004 | Muller | | |
| 6,848,291 | B1 * | 2/2005 | Johnson et al. | ..... | 72/482.2 |
| 7,152,453 | B2 * | 12/2006 | Johnson et al. | ..... | 72/481.1 |
| 7,159,439 | B2 * | 1/2007 | Gascoin et al. | ..... | 72/482.2 |
| 7,596,983 | B2 * | 10/2009 | Pabich et al. | ..... | 72/482.1 |
| 2004/0237623 | A1 | 12/2004 | Russell | | |
| 2005/0029727 | A1 | 2/2005 | Siegel | | |
| 2006/0107727 | A1 | 5/2006 | Pelech | | |

FOREIGN PATENT DOCUMENTS

| | | | |
|---|---|---|---|
| EP | 0424602 | | 5/1991 |
| EP | 1044739 | | 10/2000 |
| EP | 1342513 | A1 | 10/2003 |
| FR | 2598946 | | 11/1987 |
| JP | 7275939 | | 10/1995 |
| JP | 9108740 | | 4/1997 |
| JP | 10192987 | | 7/1998 |
| JP | 2003191017 | | 7/2003 |
| JP | 2004344918 | | 12/2004 |
| JP | 2005131686 | | 5/2005 |
| WO | WO99/01240 | | 1/1999 |
| WO | WO00/59903 | | 10/2000 |
| WO | WO01/08828 | A1 | 8/2001 |

OTHER PUBLICATIONS

English Abstract of DE 10 2005 051 368 A1, 1 pg.

1988 Derwent Publications Ltd., London, GB; FR2598946 A (Promecam Sisson) May 20, 1986 abstract.

"Rapid Clamp Home Page" from www.rapidclamp.com/index.html, believed to have been posted at least as early as May 6, 2006, printed Apr. 20, 2007 (one page).

"Press Brake Tablus" from www.pressbrakes-tools.com/, believed to have been posted at least as early as May 5, 2006, printed Apr. 20, 2007 (two pages).

GIMEC 2007 "tools and fixtures for sheet metal working" catalog from www.gimex.net/catalogo/index.htm, Oct. 2006 Edition, printed Apr. 20, 2007.

GIMEC 2005 "tools and fixtures for sheet metal working" catalog.

"THM home page" from www.thmtool.dk/gb/gb_start.htm, believed to have been posted as early as May 6, 2006, printed Apr. 20, 2007 (five pages from www.thmtool.dk/gb/gb_products.htm).

"UMV Inc Home Page" from www.umvinc.com/platform/components/cm/consume/index.asp, believed to have been posted as early as May 6, 2006, printed Apr. 20, 2007 (two pages).

"Manufacturer of press brake tools and shears for guillotine knives" from www.plasmet.c-net.pl/uk/dies4.html, printed Oct. 18, 2006 (three pages).

"UKB home page" from www.ukb-gmbh.de/wuu.php, believed to have been posted as early as May 6, 2006, printed Apr. 16, 2007 (two pages from www.ukb-gmbh.de/shop.php?ac=zeige&ProduktID=18; two pages from www.ukb-gmbh.de/shop.php?ac=zeige&ProduktID=19; ; two pages from www.ukb-gmbh.de/shop.php?ac=zeige&ProduktID=20; one page from www.ukb-gmbh.de/shop.php?ac=zeige&ProduktID=49; and one page from www.ukb-gmbh.de/shop.php?ac=zeige&ProduktID=21).

"Tools Press home page" from www.toolspress.com/sites/index/main_uk.tpl, believed to have been posted as early as May 6, 2006, printed Apr. 20, 2007 (one page from www.toolspress.com/sites/0/EN/bloccaggio.tpl; one page (isometric view) from www.toolspress.com/sites/0/EN/intellitable.tpl; one page (frontal view) from www.toolspress.com/sites/0/EN/intellitable.tpl; one page (isometric view) from www.toolspress.com/sites/0/EN/menu/intelli.html; one page (frontal view) from www.toolspress.com/sites/0/EN/intellitable_stra.tpl).

"Rolleri home page" from www.rolleri.it/elesen.php?pos=1&ser=gasparini, believed to have been posted as early as May 6, 2006, printed Apr. 20, 2007 (one page from www.rolleri.it/utensilesen.php?ser=gasparini&cod=AD-5; one page from www.rolleri.it/utensilesen.php?ser=gasparini&cod=AD-5_C; one page from www.rolleri.it/utensilesen.php?ser=gasparini&cod=AD-6; one page from www.rolleri.it/utensilesen.php?ser=gasparini&cod=AD6_C.

"American Style Die Holders" from www.rkbrakedies.com/American%20Style%20Die%20Holders.htm, believed to have been posted as early as May 6, 2006, printed Apr. 20, 2007 (two pages).

Cincinnati Standard Filler Block Specifications, 1995, two pages.

Cincinnati Crownable Filler Block, 1996, two pages.

Kazmier Tooling, Inc., Specializing in Press Brake Tooling, 32 pages, believed to have been available at least as early as May 6, 2006.

"Ram Adapters and Dies Holders" from www.specificbrakedies.com/pages/ramadp.html, printed Oct. 18, 2006 (two pages).

Kraus Company—Press Brake Tooling Home Page from www.krausco.biz/ramadapters.html, printed Oct. 18, 2006 (five pages).

FixtureWorks Home Page from www.fixtureworks.net/Home/TechSheet/tabid/57/Default.aspx?catID=QLSC150R&thumbPath=1/0/2/0, printed Oct. 18, 2006 (four pages).

Die Crowning Home Page from www.accurpress.com/diecrown.html, believed to have been posted at least as early as May 6, 2006, printed Apr. 20, 2007 (two pages).

Rapid Action Lever Clamps from www.americanclamping.com/products/metal/ActionLever.php?measure=metric, believed to have been available at least as early as May 6, 2006, printed Apr. 24, 2007 (three pages).

Wila Press Brake Productivity Guide, Jun. 2005, 217 pages (two parts).

Accell Precision Forming System brochure by AccurPress, Jan. 2007, believed to have been available in some form at least as early as May 6, 2006,12 pages.

English language abstract for JP7275939 (Amada Co Ltd.), Oct. 1995.

English language abstract for JP9108740 (Amada Co Ltd.), Apr. 1997.

English language abstract for JP10192987 (Amada Co Ltd.), Jul. 1998.

English language abstract for JP2003191017 (Amada Co Ltd.), Jul. 2003.

English language abstract for JP2004344918 (Amada Co Ltd.), Dec. 2004.

English language abstract for JP2005131686 (Amada Co Ltd.), May 2006.

English language abstract for EP0424602 (Siegert & Co GMBH), Feb. 1991.

one page from www.rolleri.it/utensilesen.php?ser=gasparini&cod=C1050_R (printed Apr. 20, 2007); one page from www.rolleri.it/utensilesen.php?ser=gasparini&cod=C1050_RS (printed 2007); one page from www.rolleri.it/utensilesen.php?ser=gasparini&cod=C2000-S (printed Apr. 20, 2007).

one page from www.rolleri.it/utensilesen.php?ser=gasparini&cod=C2500-S (printed Apr. 20, 2007); one page from www.rolleri.it/utensilesen.php?ser=gasparini&cod=C3000-S (printed Apr. 20, 2007); one page from www.rolleri.it/utensilesen.php?ser=gasparini&cod=C4000-S (printed Apr. 20, 2007); one page from www.rolleri.it/utensilesen.php?ser=gasparini&cod=CTS60 (printed Apr. 20, 2007); and one page from www.rolleri.it/utensilesen.php?ser=gasparini&cod=CTS6O_C (printed Apr. 20, 2007).

* cited by examiner

PRESS BRAKE DIE HOLDER TECHNOLOGY

FIELD OF THE INVENTION

The present invention is in the field of press brakes. More particularly, this invention relates to die holders for press brakes.

BACKGROUND OF THE INVENTION

Tooling for use with a press brake commonly includes a horizontally elongated punch having a downwardly-facing tip, and a horizontally elongated die having an upwardly open workpiece-contact portion adapted to receive the punch tip during, for example, a workpiece bending operation.

Due to the substantial forces involved in bending operations, it is important that punches and dies be kept in alignment to avoid undue wear, to assure accurate bending, and to avoid breakage. Commonly, the punch is mounted in a fixed position, and the die can be positionally adjusted into precise alignment with the punch tip. When the die holder is then locked in position, relative lateral movement between the punch and die is restrained.

A press brake die commonly has a downwardly extending tang that is mounted in an upwardly open channel of a die holder. Set screws, inserted through the side of the die holder, may be employed to lock the die's tang in the channel. In other cases, the fit between the tang and die holder is sufficiently close that no locking is provided, and as a result, the die can be removed from the die holder with some ease.

Particularly in the latter case (in which the die's tang is simply received in a closely sized channel of the die holder), some slight back and forth rocking motion or "wobble" of the die within the holder can occur, and is difficult to avoid. A very small amount of wobble or play between the die's tang and the channel is magnified at the upper portion of the die (where the die meets the punch tip). It is difficult economically to obtain tolerances that prevent such movement. If most of the wobble is to be avoided by extremely close tolerances in machining the tang and channel, the cost of machining may become economically prohibitive. Furthermore, very close tolerances between the tang and die holder make it difficult to insert the tang into the die holder.

It would be desirable to provide a die holder that offers positive die clamping. It would be particularly desirable to provide a die holder that offers positive clamping without requiring adjustment of set screws or other fasteners that require tools. It would also be desirable to provide a die holder that is convertible between a hydraulically-operable state and a manually-operable state. Further, it would be desirable to provide a die holder having one or more die-contact bodies that deliver downward force to the tang of a die during clamping. Finally, it would be desirable to provide a die holder having selected surfaces coated with wear-resistant coating.

SUMMARY OF THE INVENTION

In certain embodiments, the invention provides a press brake die holder for holding a die having an upper, workpiece-contact portion and a lower, elongated tang. The die holder has a first shoulder, a second shoulder, a base, and an elongated channel adapted to receive the tang of the die. In the present embodiments, the die holder further includes an elongated locking bar adapted for movement toward the second shoulder of the die holder so as to positively clamp the tang when the tang is positioned in the channel. The present embodiments involve the first shoulder of the die holder carrying at least one cam member, which is adapted to move so as to cause a camming action between the cam member and the locking bar. This camming action causes the movement of the locking bar toward the second shoulder of the die holder.

Some embodiments of the invention provide a press brake die holder for holding a die having an upper, workpiece-contact portion and a lower, elongated tang. In the present embodiments, the die holder is adapted for conversion between a first operatively-assembled configuration having a manually-operable actuator unit and a second operatively-assembled configuration having a hydraulically-operable actuator unit. The die holder has a block that includes a base and a shoulder. Preferably, the base and shoulder together have a generally L-shaped configuration. In the present embodiments, the die holder further includes an elongated locking bar. This locking bar has a first clamping wall, while the noted shoulder has a second clamping wall. Here, the die holder is provided with a rigid fastening assembly adapted to rigidly attach the base, as desired, either to a lower portion of the manually-operable actuator unit or to a lower portion of the hydraulically-operable actuator unit. This die holder is also provided with a resilient fastening assembly adapted to resiliently attach the locking bar, as desired, either to an upper portion of the manually-operable actuator unit or to an upper portion of the hydraulically-operable actuator unit.

In certain embodiments, the invention provides a press brake die holder for holding a die having an upper, workpiece-contact portion and a lower, elongated tang. The die holder has two confronting walls between which the tang can be positioned. A desired one of the walls is adapted for being moved toward the other wall so as to positively clamp the tang when the tang is positioned between the two walls. In the present embodiments, the die holder is provided in combination with both a manually-operable actuator unit and a hydraulically-operable actuator unit, and the die holder is adapted for conversion between a first operatively-assembled configuration that includes the manually-operable actuator unit and a second operatively-assembled configuration that includes the hydraulically-operable actuator unit.

Some embodiments of the invention provide a press brake die holder for holding a die having an upper, workpiece-contact portion and a lower, elongated tang. The die holder has two confronting walls between which the tang can be positioned, and a desired one of the two walls is adapted for being moved toward the other wall so as to positively clamp the tang when the tang is positioned between the two walls. In the present embodiments, the die holder has a die-contact body that delivers a downward force to the tang when the tang is positively clamped between the two walls. This downward force urges the tang downwardly toward a base of the die holder (which base typically extends between the two walls of the die holder). Preferably, the die holder and die-contact body are adapted to deliver the downward force to the tang even when the opposed clamping surfaces of the tang consist of parallel planar surfaces. In certain embodiments of this nature, during positive clamping of the die's tang between the two confronting walls, the die-contact body delivers the downward force as a frictional force. Some of the present embodiments involve the two confronting walls both carrying die-contact bodies adapted to collectively deliver the downward force. In such embodiments, the die-contact bodies can optionally be mounted on the confronting walls so as to have limited range freedom of movement relative to the confronting walls. In one advantageous embodiment, the die-contact bodies are wedge members that, during positive clamping of the die's tang between the two confronting walls, move downwardly relative to the confronting walls (e.g., the base of the die holder).

Certain embodiments of the invention provide a press brake die holder for holding a die having an upper, workpiece-contact portion and a lower, elongated tang. The die holder has two confronting walls between which the tang can be positioned. A desired one of the two walls is adapted for being moved toward the other wall so as to positively clamp the tang when the tang is positioned between the two walls. In the present embodiments, the die holder has a resilient body that delivers a downward force to the tang when the tang is positively clamped between the two walls. This downward force urges the tang downwardly toward a base of the die holder.

In some embodiments, the invention provides a press brake die holder for holding a die having an upper, workpiece-contact portion and a lower, elongated tang. The die holder has a block that includes a base and a shoulder. Preferably, the base and shoulder together have a generally L-shaped configuration. In the present embodiments, the die holder further includes an elongated locking bar. Preferably, the locking bar has a first clamping wall, and the noted shoulder has a second clamping wall. In the present embodiments, the locking bar's clamping wall is defined by uncoated metal, and the locking bar has a bottom wall that bears a coating and that is adapted to slide along a coating on the base during clamping and unclamping actions of the die holder. Further, the noted shoulder preferably has an upwardly-facing loading surface (optionally one along which a downwardly-facing loading surface of the die is adapted to slide during positioning of the die at such time as the die holder is in an unclamped position) that has a coating. Still further, the locking bar preferably has an upwardly-facing loading surface (optionally one along which a downwardly-facing loading surface of the die is adapted to slide during positioning of the die at such time as the die holder is in the unclamped position) that has a coating.

In some embodiments involving a locking bar, the locking bar has a long axis parallel to the die holder's longitudinal axis (e.g., parallel to the die holder's channel), and the locking bar is adapted to move (e.g., laterally) in a horizontal plane perpendicular to the locking bar's long axis during clamping and unclamping actions of the die holder.

DETAILED DESCRIPTION OF PREFERRED EMBODIMENTS

Figure 1:
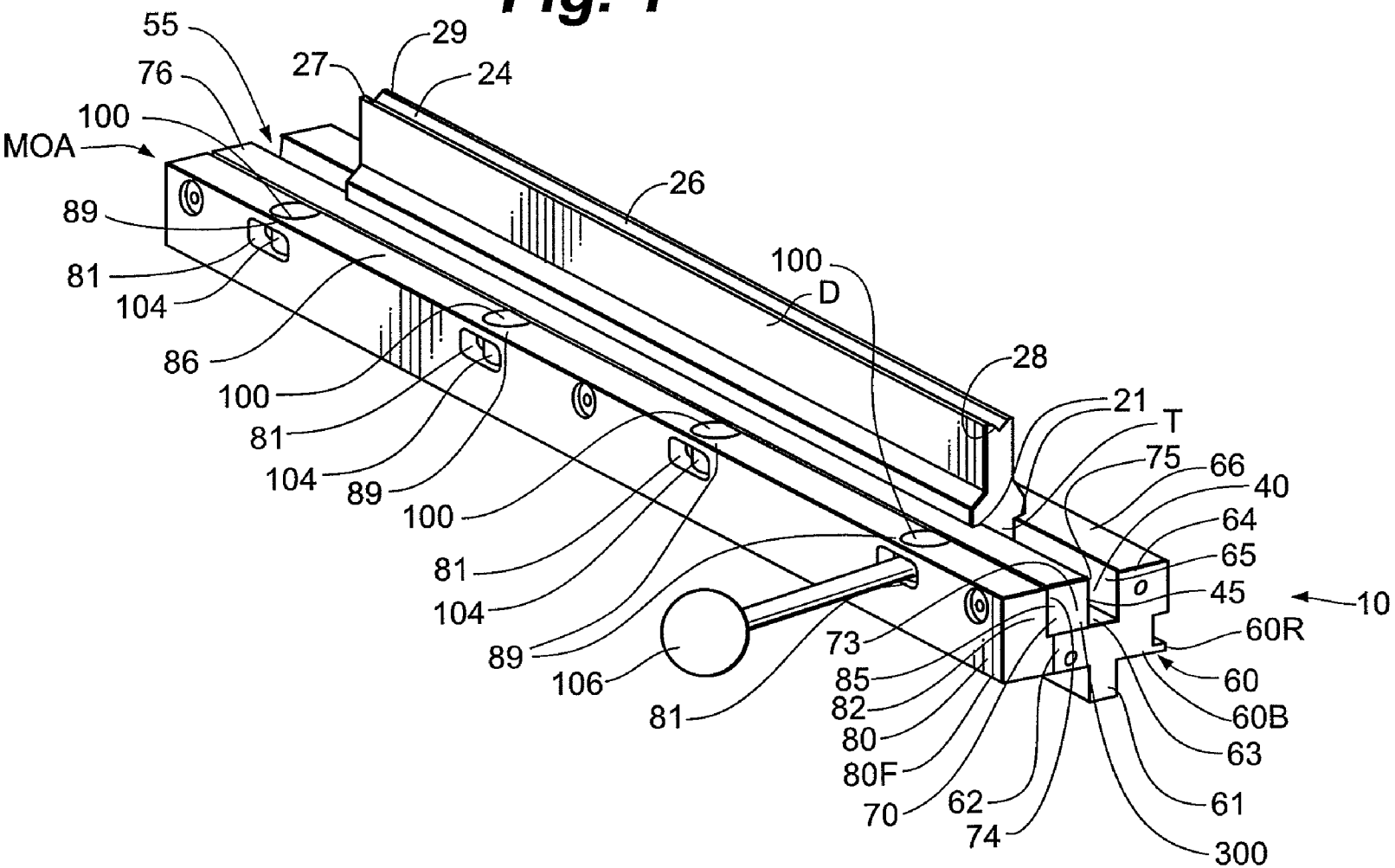
FIG. 1 is a perspective view of a die holder on which is mounted a die in accordance with certain embodiments of the present invention.

The following detailed description is to be read with reference to the drawings, in which like elements in different drawings have like reference numerals. The drawings, which are not necessarily to scale, depict selected embodiments and are not intended to limit the scope of the invention. Skilled artisans will recognize that the given examples have many useful alternatives, which fall within the scope of the invention.

The die holder is designated by the reference numeral 10. Typically, the die holder is adapted for being mounted (or is mounted) on a lower beam of a press brake. Reference is made to U.S. Pat. No. 6,119,503 (Peloquin et al.) and U.S. Pat. No. 6,516,649 (Mika et al.), the teachings (including the drawings) of which concerning exemplary ways to mount a die holder on the lower beam of a press brake are incorporated herein by reference. In some (though not all) cases, the die holder is mounted on a stationary lower bean (or table) LT of a press brake PB. In these cases, the die holder 10 is a vertically-fixed die holder (i.e., one that is not moveable (and does not move) vertically during the press brake's pressing/punching stroke). In these embodiments, the die holder 10 will typically be located directly below a vertically-moveable punch holder PH mounted on an upper beam (or table) of the press brake PB.

Figure 26:
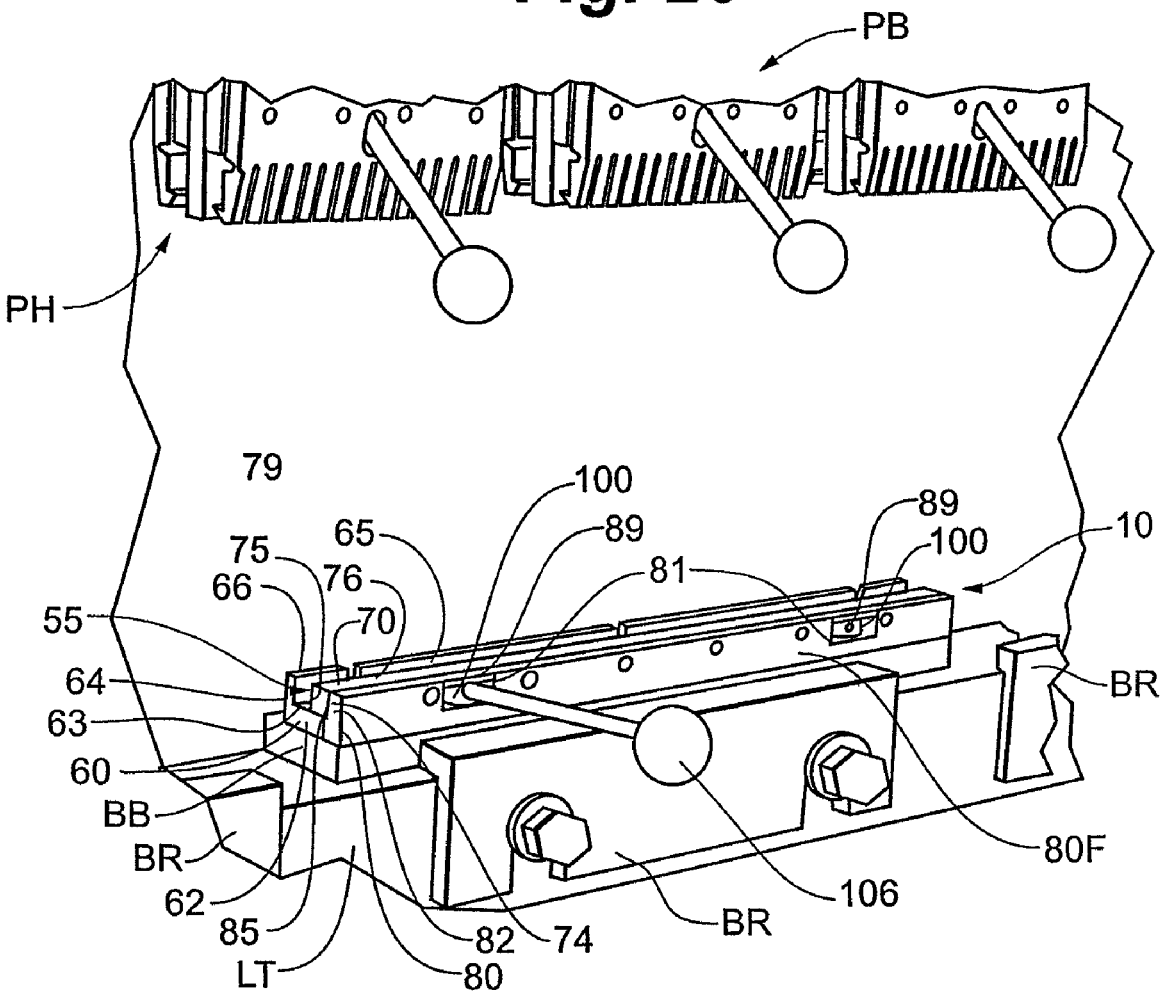
FIG. 26 is a broken-away perspective view of a press brake on which is mounted a die holder in accordance with certain embodiments of the invention.

FIG. 26 schematically illustrates a press brake PB utilizing a die holder 10 in accordance with certain embodiments of the present invention. The press brake includes a series of horizontally aligned upper clamps, which are used to clamp punches (not shown) against a support plate. The clamp is brought into clamping engagement with the punch by means of an upper handle. Useful press brake punch holders are described in PCT International Publication No. WO 99/01240 (the salient teachings of which are incorporated herein by reference). The punches disclosed in this PCT Publication are solely for purposes of illustration. The present die holder can be used on any press brake without requiring any specific punches or punch holders.

The die holder 10 is mounted on a lower table LT of the press brake PB. The die holder 10 is shown with a base block BB. The base block may be attached to the lower table LT in any suitable fashion. For example, the base block may be held in place on the lower table by means of a pair of opposed brackets BR. (Only one of the opposed brackets is shown in FIG. 26, the other of the pair being positioned behind the die holder 10 and thus being obscured from view.) The bracket desirably can be adjusted to release the base block BB. This releasable attachment of the die holder 10 to the lower table LT permits the die holder 10 to be selectively retrofitted to any standard press brake. It is to be understood that many different crowning systems can be provided with the present die holder.

The die holder 10 is adapted for holding a press brake die D. Typically, the die D has an upper, workpiece-contact portion and a lower, elongated tang T. Many different types of press brake dies can be used. FIGS. 1, 2, 9, and 10 depict one exemplary press brake die D, of known design, which includes an upper portion having a generally V-shaped groove 24 defined by upwardly divergent, intersecting walls 26, 28. These walls terminate upwardly at edge surfaces 27, 29, which may be smooth and gently rounded to enable a workpiece to slide readily over these surfaces during a bending operation. This, however, is merely one useful die configuration. People knowledgeable in this field of technology will appreciate that many different types of dies can be used.

In some embodiments, the die D has downwardly-facing shoulders that define surfaces 21. These surfaces 21 preferably are adapted to be (and in some cases, are) carried against corresponding upwardly-facing surfaces 66, 76 of the die holder 10. In other cases, the bottom surface 221 of the die's tang T is carried against the die holder's base 62 during operation. For example, some useful dies do not have mounting shoulders, but rather use the bottom surfaces 221 of their tangs as mounting surfaces.

The die D has, at its lower end, a tang T. In some cases, the tang T is generally square or generally rectangular in cross section (i.e., in vertical cross section). As is perhaps best seen in FIGS. 2 and 10, the tang T has opposing (in some cases, generally parallel) walls 144, 146, which are adapted to be clamped by the die holder. For some types of dies, the walls 144, 146 may have grooves, angled surfaces, or other contours.

The die D is configured for use with a corresponding punch. In some cases, the punch has a downwardly facing, V-shaped tip, which during a bending operation is pressed into the V-shaped groove 24 of a die D like that described above. In such cases, it will be understood that a workpiece (such as a piece of sheet metal) is positioned between the punch and die, and is bent when the punch descends into the die. The present die holder, however, is not limited to use with any particular type of die. Rather, many different types of dies can be used.

The die holder 10 includes a first shoulder 82, a second shoulder 64, and a base 62. The die holder 10 has an elongated channel 55, which is adapted to receive the tang T of a die D. Preferably, the channel 55 is upwardly open (e.g., is an upwardly-open slot). In some embodiments, the channel 55 is generally square or generally rectangular in cross section (e.g., in vertical cross section taken perpendicular to clamping wall 65). In certain embodiments, the channel's width (which extends along the die holder's X axis, or "lateral axis") can be varied by moving a locking bar 70 (described below) selectively toward or away from the die holder's second shoulder 64.

In the illustrated embodiments, the die holder's second shoulder 64 and base 62 are parts of a single (i.e., integral) block 60. In other cases, the base 62 and the second shoulder 64 are separate bodies attached together to form the block 60. Either way, the block 60 preferably is formed of metal or another rigid material. For example, P20 grade prehard material with a hardness of 28-32 and nitrided surface treatment to a 70 HRC can be used. Of course, other materials can be used, and this example is by no means limiting.

The illustrated base 62 and shoulder 64 together have a generally L-shaped configuration. For example, the illustrated shoulder 64 (a clamping wall 65 thereof, or a planar portion of such clamping wall) may extend away from one end of the base 62 at an angle that is at least generally normal (e.g., about 90 degrees). When the die holder is operatively assembled and mounted on the lower beam of a press brake (FIG. 26), the shoulder 64 rises vertically upwardly from one end of the base 62. As is perhaps best seen in FIG. 2, in addition to the L-shaped configuration of the base 62 and shoulder 64, the block 60 may have a downwardly extending tang 61. Moreover, in some embodiments, the block 60 defines a U-shaped configuration. Reference is made to the exemplary embodiments of FIGS. 18-23. People familiar with this area of technology will understand that the precise configuration of the block 60 will vary, e.g., depending upon the manner in which the die holder is to be mounted on the lower beam of a press brake.

Certain embodiments provide a die holder having an elongated locking bar. In these embodiments, the locking bar 70 is adapted to move (e.g., laterally) toward the die holder's second shoulder 64 so as to positively clamp the tang T when the tang is positioned in the channel 55. The locking bar 70, for example, may have a long axis parallel to the die holder's longitudinal axis (e.g., parallel to the die holder's channel 55), and this bar 70 may be adapted to move (e.g., laterally) in a horizontal plane perpendicular to the locking bar's long axis during clamping and unclamping actions of the die holder.

The locking bar 70 can optionally have a generally square or generally rectangular cross section (taken in a vertical plane perpendicular to clamping wall 65). In the illustrated embodiments, the locking bar 70 has an upwardly-facing (e.g., planar) top surface 76 that (when the die holder is operatively mounted on the lower table of a press brake) lies in substantially the same horizontal plane as (e.g., is at least generally flush to, is at least substantially flush to, or is flush to) the upwardly-facing top surface 66 of shoulder 64 (and/or to the upwardly-facing top surface 86 of shoulder 82).

In some cases, the locking bar 70 also has a downwardly-facing (e.g., planar) surface 73 that is adapted to slide against the die holder's base 62 during clamping and unclamping actions of the die holder.

The length of the locking bar (i.e., its major dimension) preferably extends parallel to the length of the die holder's channel 55. In some embodiments, the locking bar 70 has a length of at least 4 inches, or at least 5 inches.

Certain embodiments of the invention provide an arrangement wherein one locking bar, or a plurality of locking bars disposed serially in an end-to-end fashion, extends alongside (and bands one side of) the entire length (or substantially the entire length) of the die holder's channel. When provided, the (or each) locking bar 70 preferably defines a clamping wall 75 that is adapted to contact the die's tang T during the tool holder's clamping action. Preferably, the clamping wall 75 extends along the entire length, or substantially the entire length, of the locking bar 70.

The locking bar 70 preferably is formed of metal or another rigid material. Again, P20 grade prehard material with a hardness of 28-32 and nitrided surface treatment to a 70 HRC can be used. However, other materials can be used, and this example is by no means limiting.

In FIGS. 1-8B, the die holder's first shoulder 82 is part of a camming actuator unit (optionally, a manually-operable camming actuator unit, as described below). Here, the first shoulder 82 is defined by a block 80, which in these figures is not integral to (i.e., is a different body than) the block 60 comprising the base 62 and second shoulder 64. The block 80 preferably is formed of metal or another rigid material. Here again, P20 grade prehard material with a hardness of 28-32 and nitrided surface treatment to a 70 HRC can be used. Other materials can be used, of course, and this example is by no means limiting.

In FIGS. 1-8B, the block 80 defining the first shoulder 82 preferably is adapted for being removably attached to the block 60 comprising the base 62 and second shoulder 64. Between the illustrated removable first shoulder 82 and the second shoulder 64 are located the laterally-moveable locking bar 70 and the channel 55. In more detail, the illustrated locking bar 70 is located between the first shoulder 82 and the channel 55.

Figure 2:
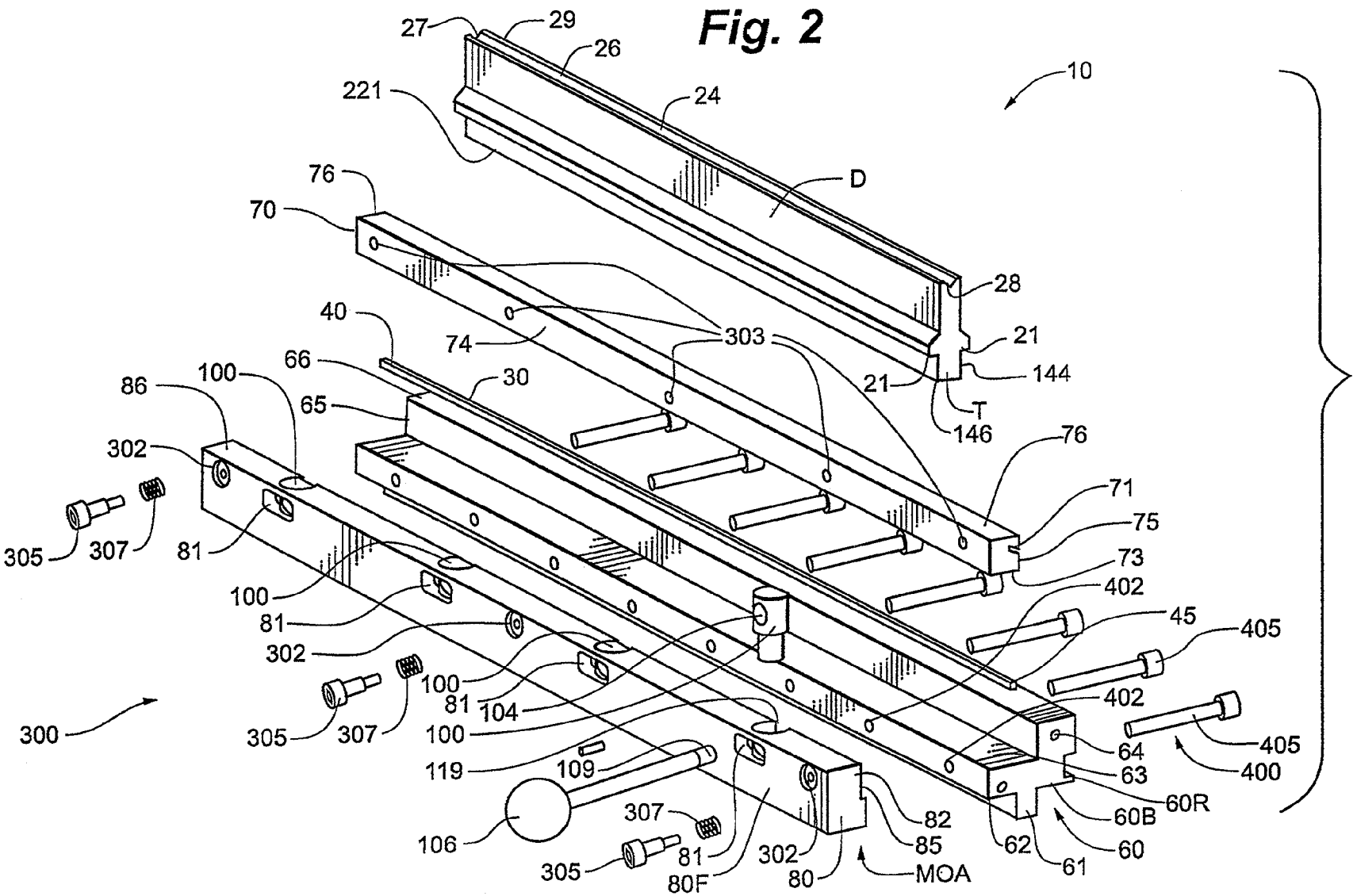
FIG. 2 is a partially exploded perspective view of the die holder and die of FIG. 1.
Figure 7:
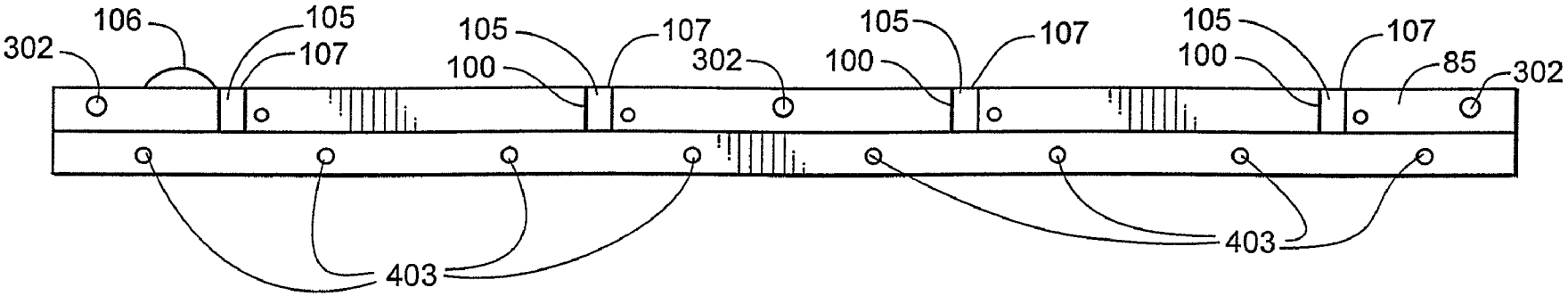
FIG. 7 is a back view of the manually-operable actuator unit of FIG. 4.

The blocks 60, 80 can be removably attached to each other in different ways. Referring to FIGS. 2 and 7, it can be seen that one option involves a plurality of fasteners 405 that can be extended through respective openings 402 in the die holder's base 62 and into corresponding openings 403 in block 80. More generally, though, it should be appreciated that many different removable fastening systems can be used.

In the embodiments exemplified by FIGS. 1-8B and 18-23, the die holder's first shoulder 82 carries at least one cam member 100 adapted to be moved (optionally rotated) so as to cause a camming action between such cam member and the locking bar 70. This camming action forces the locking bar 70 to move toward the second shoulder 64 of the die holder (hence decreasing the width of the channel 55). Various arrangements can be used to provide this type of camming action.

Referring to FIGS. 1-8B, 18 and 19, the illustrated locking bar 70 has a rear wall 74 facing the first shoulder 82 of the die holder 10. Here, the camming action involves each of a plurality of cam members 100 camming against the rear wall 74 of the locking bar 70 so as to force the locking bar to move toward the second shoulder 64 of the die holder 10. In other embodiments, the camming action involves a single cam member camming against the rear wall of the locking bar.

One group of embodiments involves a cam member 100 that is adapted to protrude from a cavity 119 that opens through an inner wall (i.e., a wall facing the direction of the channel) 85 of the die holder's first shoulder 82. In some embodiments of this nature, during the die holder's camming action, the cam member 100 protrudes from the opening 119 while moving (optionally rotating) so as to cam with the locking bar 70 (optionally camming with the locking bar's rear wall 74). Embodiments of this nature can advantageously involve a plurality of cam members 100 adapted to function in this way.

As noted above, the die holder's camming action may be initiated by rotation of the cam member. This may involve rotational non-linear motion. However, the cam member's movement can alternatively be linear motion. For example, this may involve linear non-rotational motion. Further, the cam member's movement may involve simultaneous linear and rotational motion. Still further, the die holder may include cam members that move in different manners to initiate camming (e.g., one cam member may undergo rotational non-linear motion, while another cam member undergoes linear non-rotational motion).

As camming occurs (and as the locking bar moves toward the die holder's second shoulder 64 in response to the camming), the distance between the locking bar 70 and the second shoulder 64 decreases (hence the width of the channel decreases). When the camming action is initiated at such time as the tang T of a die D is in the channel 55, the resulting movement of the locking bar 70 positively clamps the tang of the die.

In some embodiments, the die holder's camming action involves a cam member 100 moving so as to cam with an interior wall (i.e., a wall bounding an interior cavity 177) of the locking bar 70. Reference is made to FIGS. 20-23. Here, the cam member 100 has a generally planar wall section 105 and a convex wall section 107. When the end 109 of the illustrated handle 106 is inserted into the cam member's cavity 104, and the handle is then moved horizontally, the cam member rotates between first and second configurations (or "orientations"). When the cam member 100 is in its first configuration, the planar wall section 105 directly faces the locking bar 70. When the handle 106 is then turned so as to move the cam member 100 from its first configuration to its second configuration, the convex wall section 107 cams with the interior wall 174 of the locking bar 70 in such a way that the locking bar is forced to move toward the die holder's second shoulder 64.

FIGS. 20-23 exemplify a broad group of embodiments wherein the die holder 10 has a lateral width of 80 mm or less, perhaps more preferably 75 mm or less, and perhaps optimally 65 mm or less (such as about 60 mm). The design of FIGS. 20-23 lends itself nicely to the slim dimensions noted in this paragraph. More generally, though, any design/embodiment disclosed in this specification can optionally have a width in any one or more of the noted ranges.

Referring again to FIGS. 1-8B, the illustrated die holder 10 has a plurality of cam members 100. These cam members 100 are spaced apart along the length (which extends along the die holder's Z axis, or "longitudinal axis") of the die holder's first shoulder 82. In alternate embodiments, a single longitudinally elongated cam member may be provided.

Figure 8A:
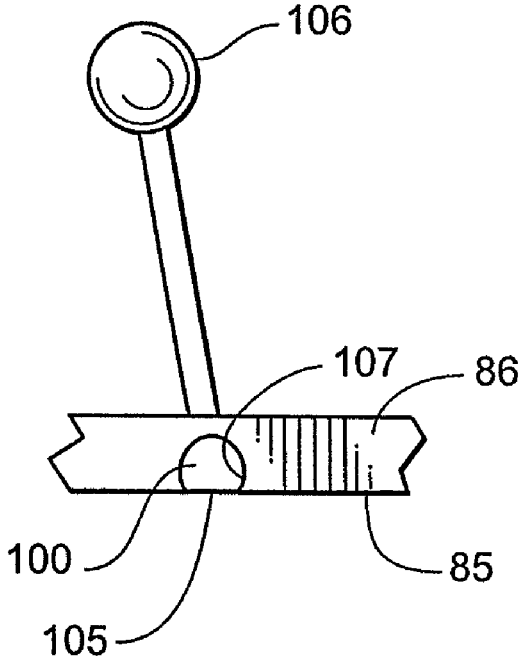
FIG. 8A is a broken-away top view of the manually-operable actuator unit of FIG. 4, wherein the illustrated cam member is shown in a first configuration.
Figure 8B:
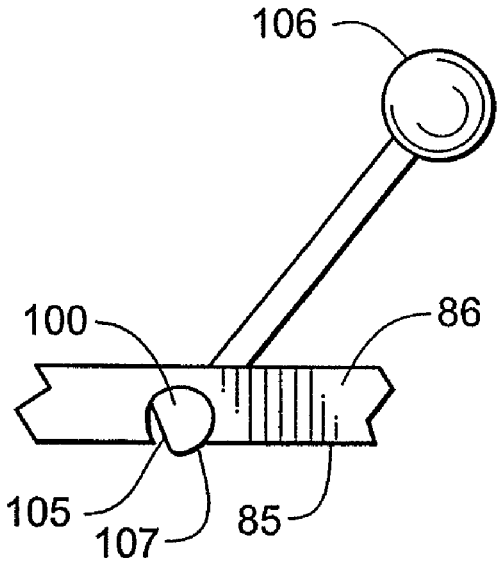
FIG. 8B is a broken-away top view of the manually-operable actuator unit of FIG. 4, wherein the illustrated cam member is shown in a second configuration.

With continued reference to FIGS. 1-8B, the die holder's camming action results when the (or each) cam member 100 is moved from a first configuration to a second configuration. FIGS. 8A and 8B depict exemplary first and second configurations. Here, the cam member 100 moves rotationally between its first and second configurations. In FIG. 1, when all the illustrated cam members 100 are in their first configurations, the locking bar 70 is held against (e.g., directly against) the first shoulder 82 of the die holder, and when all the cam members are in their second configurations, the locking bar 70 is spaced apart from the die holder's first shoulder 82 (and/or is closer to the die holder's second shoulder 64). In these particular embodiments, the locking bar 70 is resiliently biased toward the die holder's first shoulder 82 such that, when all the cam members 100 are in their first configurations, the locking bar is held resiliently against the first shoulder. Thus, the locking bar 70 may have a default position in which it is held against the die holder's first shoulder 82 unless the die holder's camming action is initiated (or the resilient bias on the locking bar is otherwise overcome). This can advantageously give the die holder a fully-open default configuration, which facilitates positioning tools on the die holder.

In some of the present embodiments, the die holder 10 undergoes its camming action in response to a press brake operator performing a manual tool-free operation. Reference is made to FIGS. 1-8B, 18-23, and 26. The die holder, for example, can have one or more cam members 100 adapted to rotate in response to movement of a manually operated handle 106. One end 109 of the handle 106 may be adapted to be received (e.g., removably) by the cam member. Thus, a press brake operator may simply insert the end 109 of the handle 106 into each cam member (e.g., into a cavity 104 therein), then manually turning the handle (so as to rotate such cam member) to positively clamp the die holder 10 on the tang T of a die D. This allows the operator to clamp the die holder easily, positively, and without having to use screwdrivers, allen wrenches, or other tools.

In one group of embodiments, the die holder 10 includes at least one cam member 100 that is adapted to rotate about a vertical axis to initiate the die holder's camming action. Reference is made to FIGS. 1-8B, 19-23, and 26. Here, the die holder's camming action may be initiated by turning the handle 106 horizontally. Horizontal handle control is particularly practical and advantageous.

Figure 3:
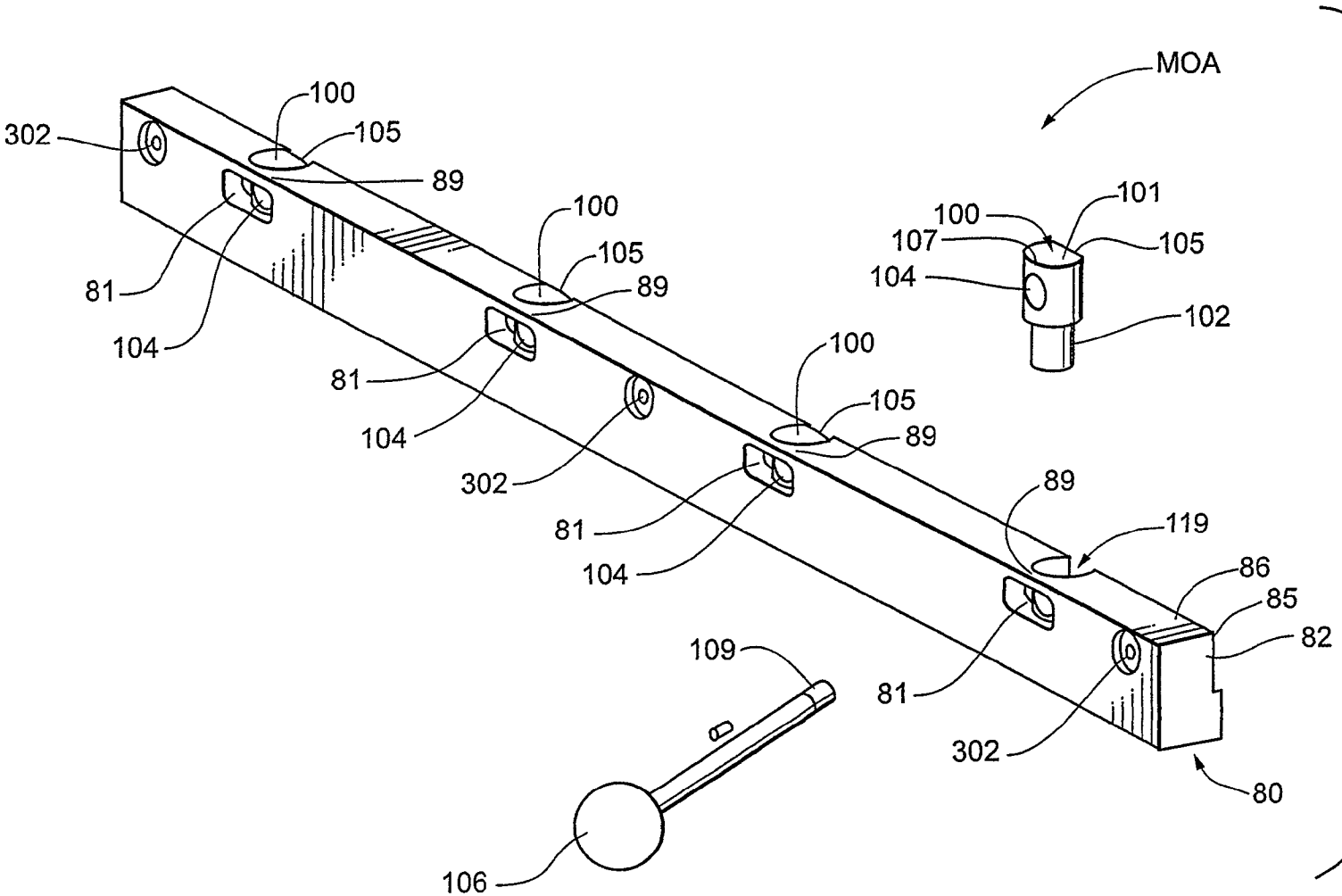
FIG. 3 is a partially exploded perspective view of a manually-operable actuator unit that is provided in certain embodiments of the invention.
Figure 4:
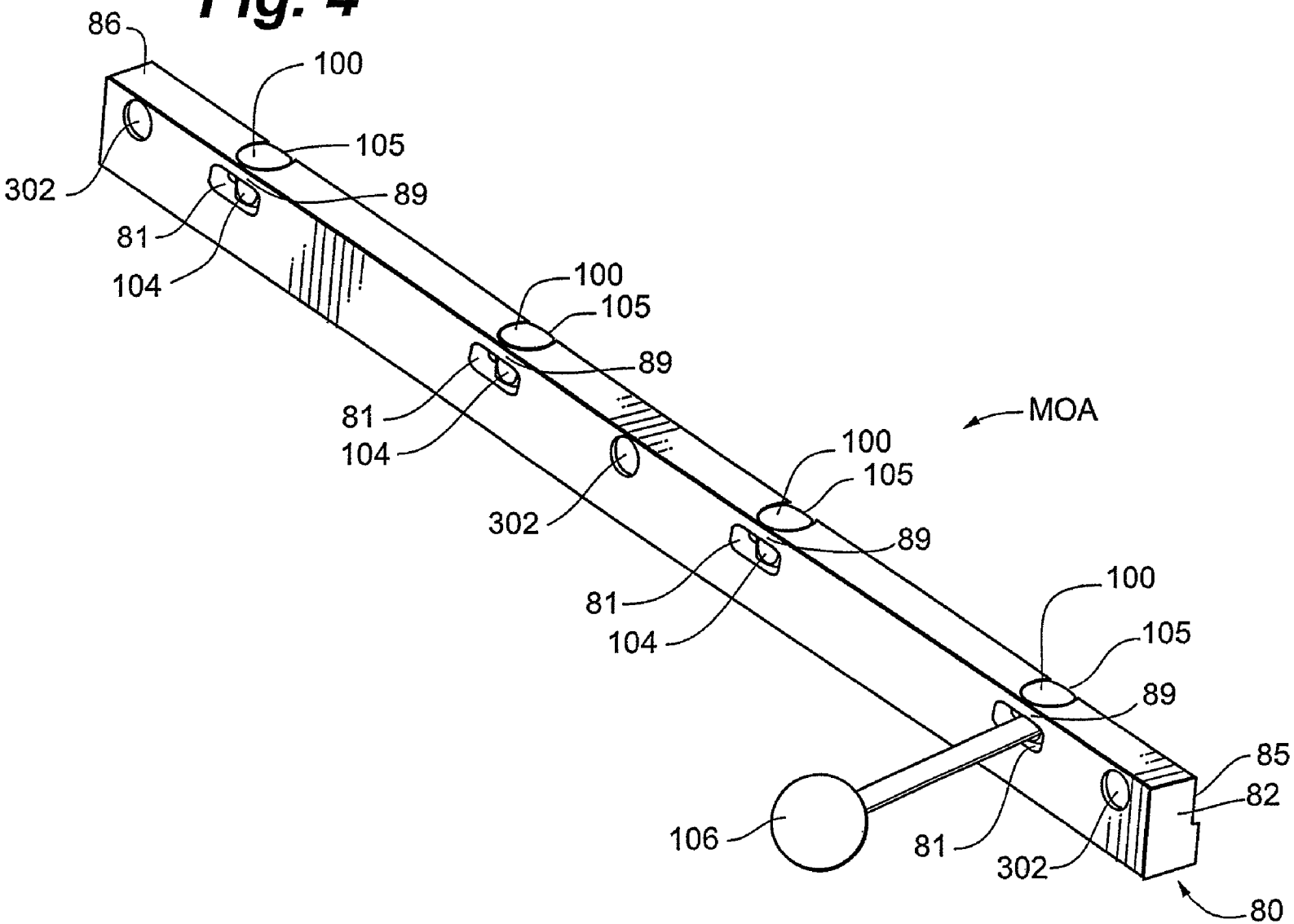
FIG. 4 is a perspective view of the manually-operable actuator unit of FIG. 3.
Figure 5:
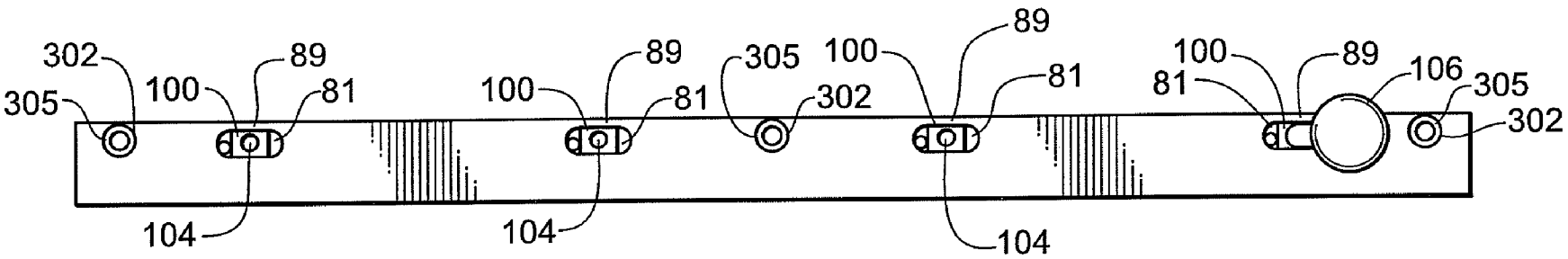
FIG. 5 is a front view of the manually-operable actuator unit of FIG. 4.
Figure 6:
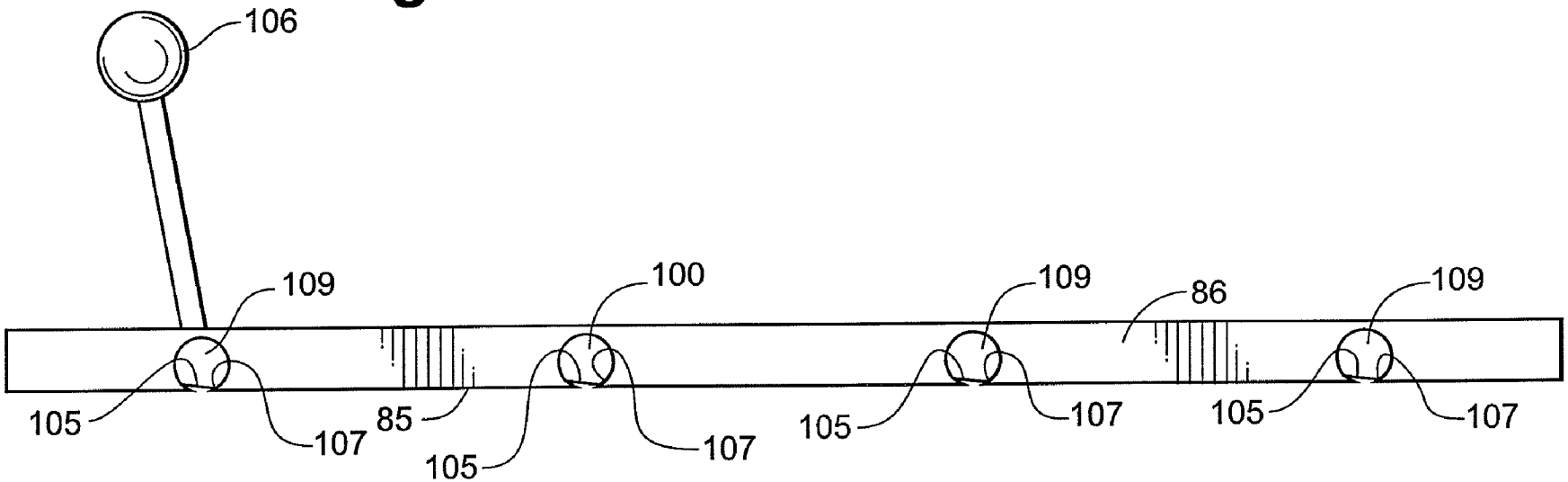
FIG. 6 is a top view of the manually-operable actuator unit of FIG. 4.

The cam member(s) 100 can be provided in various forms. One group of embodiments provides a cam member 100 having a generally-cylindrical configuration. FIG. 3 depicts one useful cam member 100 with a generally-cylindrical configuration. Here, the cam member 100 has a post-like bottom section (or "neck") 102 and an upper head 101 having a larger diameter than the post-like bottom section. The illustrated head 101, which is adapted to cam with the locking bar 70, has a generally planar wall section 105 and a convex wall section 107. Many different configurations can be used for the cam member. In some cases, only a portion of the (or each) cam member has a cylindrical (or generally cylindrical) configuration. If desired, the die holder can have different cam members with different configurations.

FIGS. 20-23 depict another useful cam member configuration. Here, when the die holder is operatively assembled, the cam member 100 (or at least a head portion 101 thereof) is received in an interior cavity 177 defined by the locking bar 70. This design represents a broader group of embodiments wherein (whether or not any part of the cam member is received in a cavity of the locking bar) the die holder's first shoulder 82 has a width less than the width of the die holder's second shoulder 64. In the exemplary embodiments of FIGS. 20-23, the width (e.g., average width, or maximum width) of the first shoulder 82 is less than half the width (average or maximum) of the second shoulder 64. This is perhaps best seen in FIG. 22.

Figure 18:
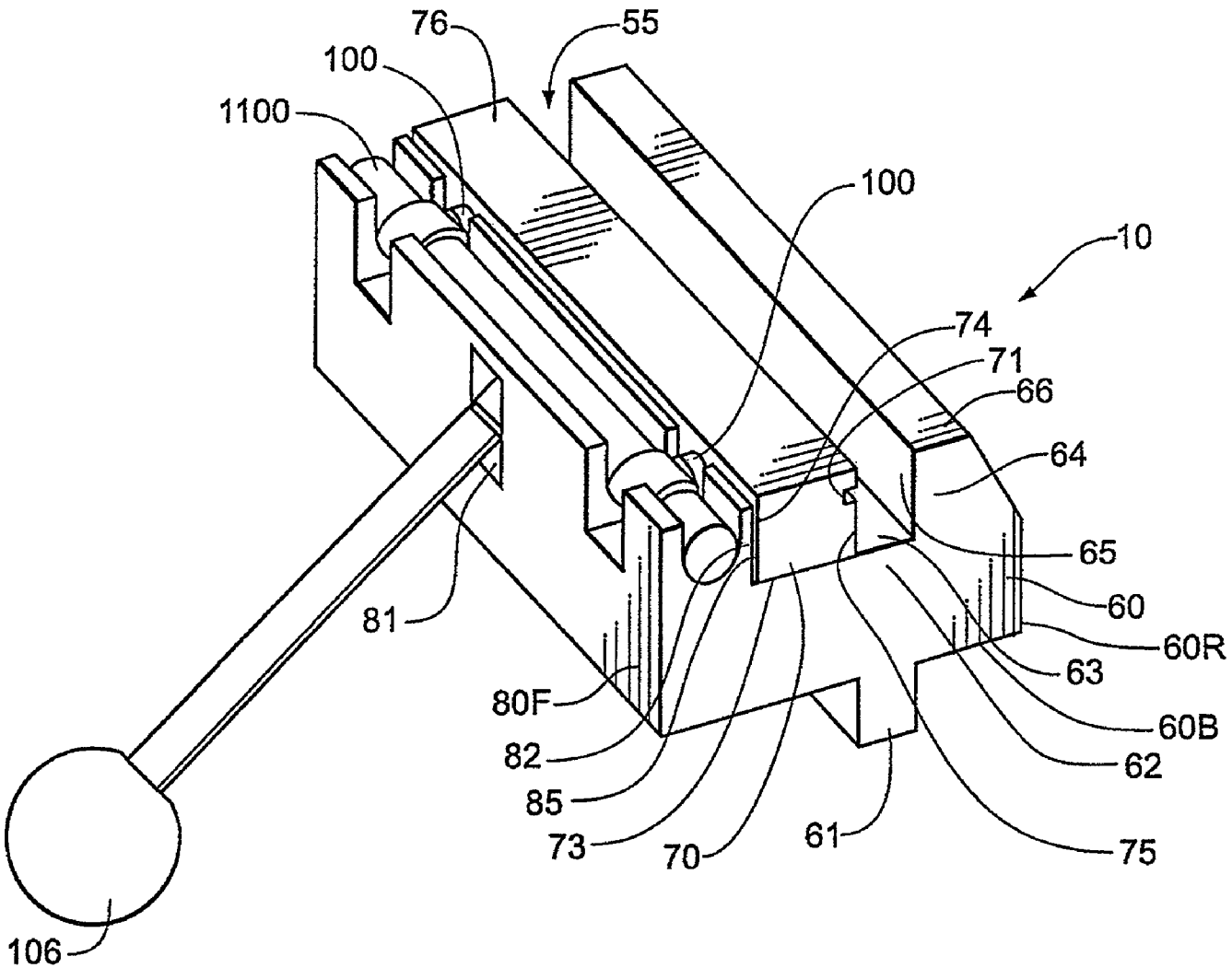
FIG. 18 is a perspective view of a die holder in accordance with certain embodiments of the invention.

FIG. 18 depicts another useful cam member design. Here, the die holder's first shoulder 82 carries a rotatable rod 1100. The rod 1100 has a long axis parallel to the die holder's channel 55. A plurality of cam members 100 are carried by (e.g., rigidly attached to) the rod 1100 at locations spaced apart along the length of the die holder's first shoulder 82. The rod 1100 preferably has a cavity into which an end of a handle 106 can be inserted, whereupon a press brake operator can turn the handle (in this case, by moving the handle in a vertical plane) to cause the cam members 100 to rotate together with the rod. During this rotation, the cam members 100 simultaneously cam with the locking bar 70. This camming action forces the locking bar to move toward the die holder's second shoulder 64.

Figure 19:
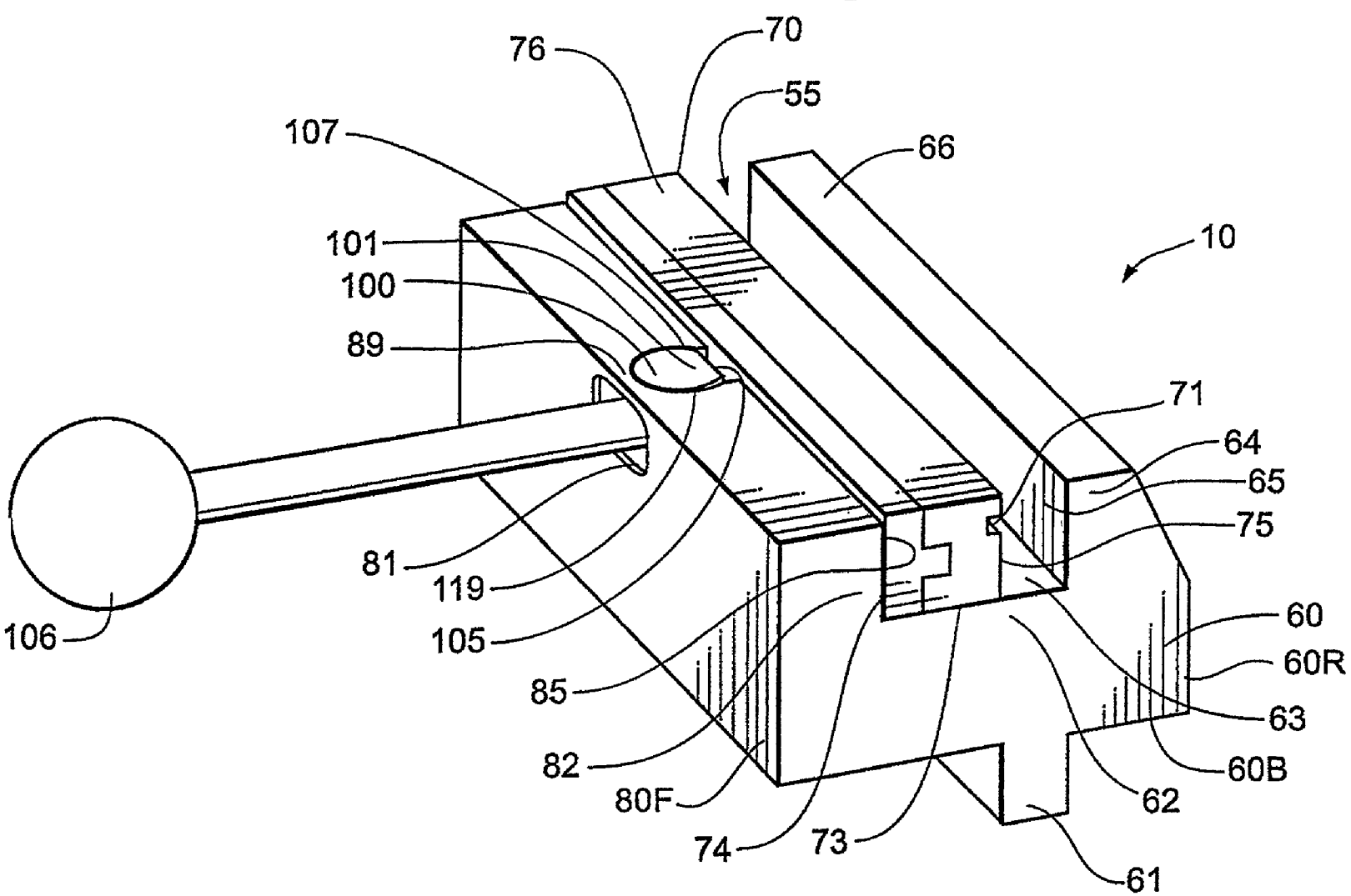
FIG. 19 is a perspective view of another die holder in accordance with certain embodiments of the invention.
Figure 20:
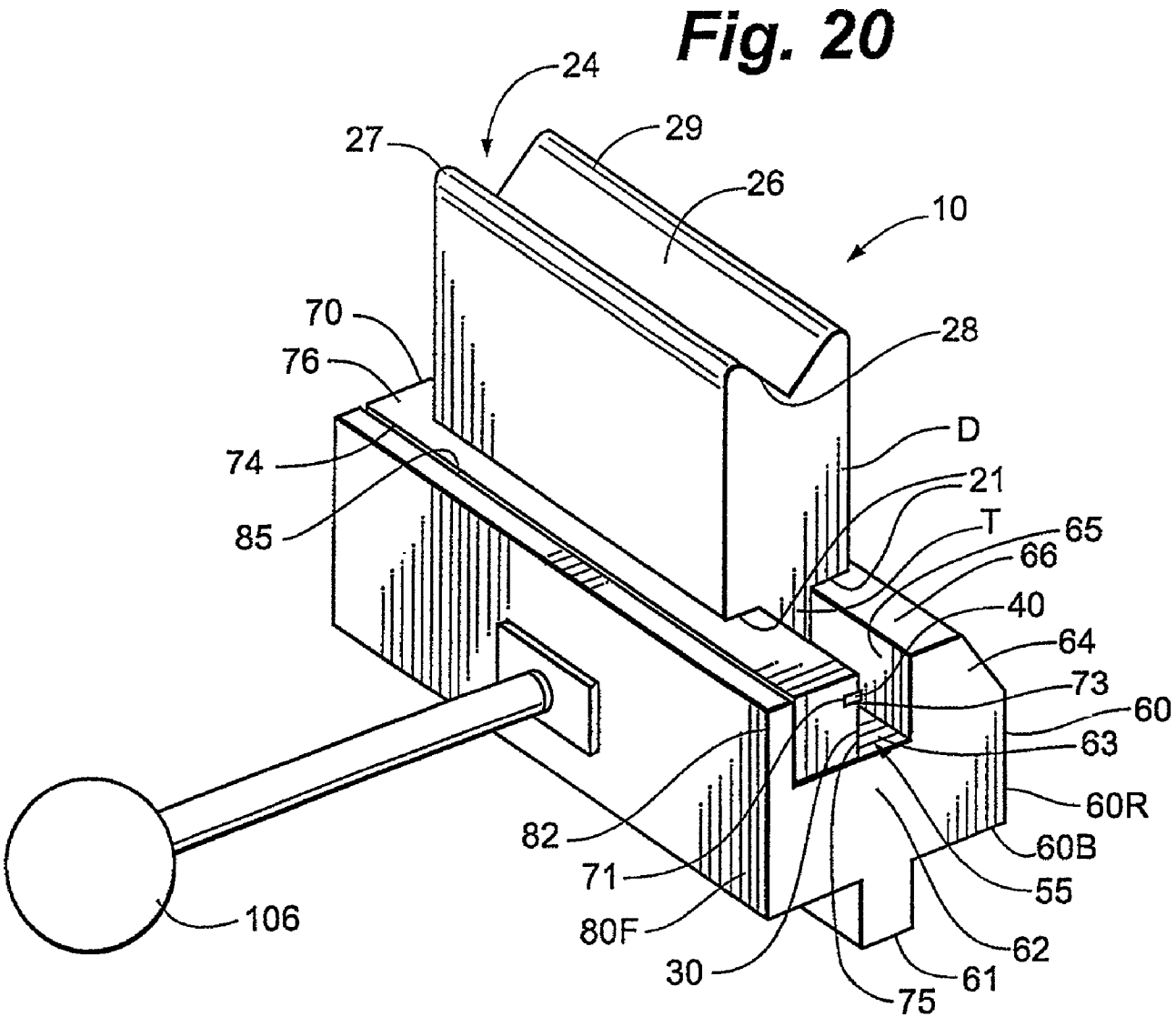
FIG. 20 is a perspective view of a die holder on which is mounted a die in accordance with certain embodiments of the invention.
Figure 21:
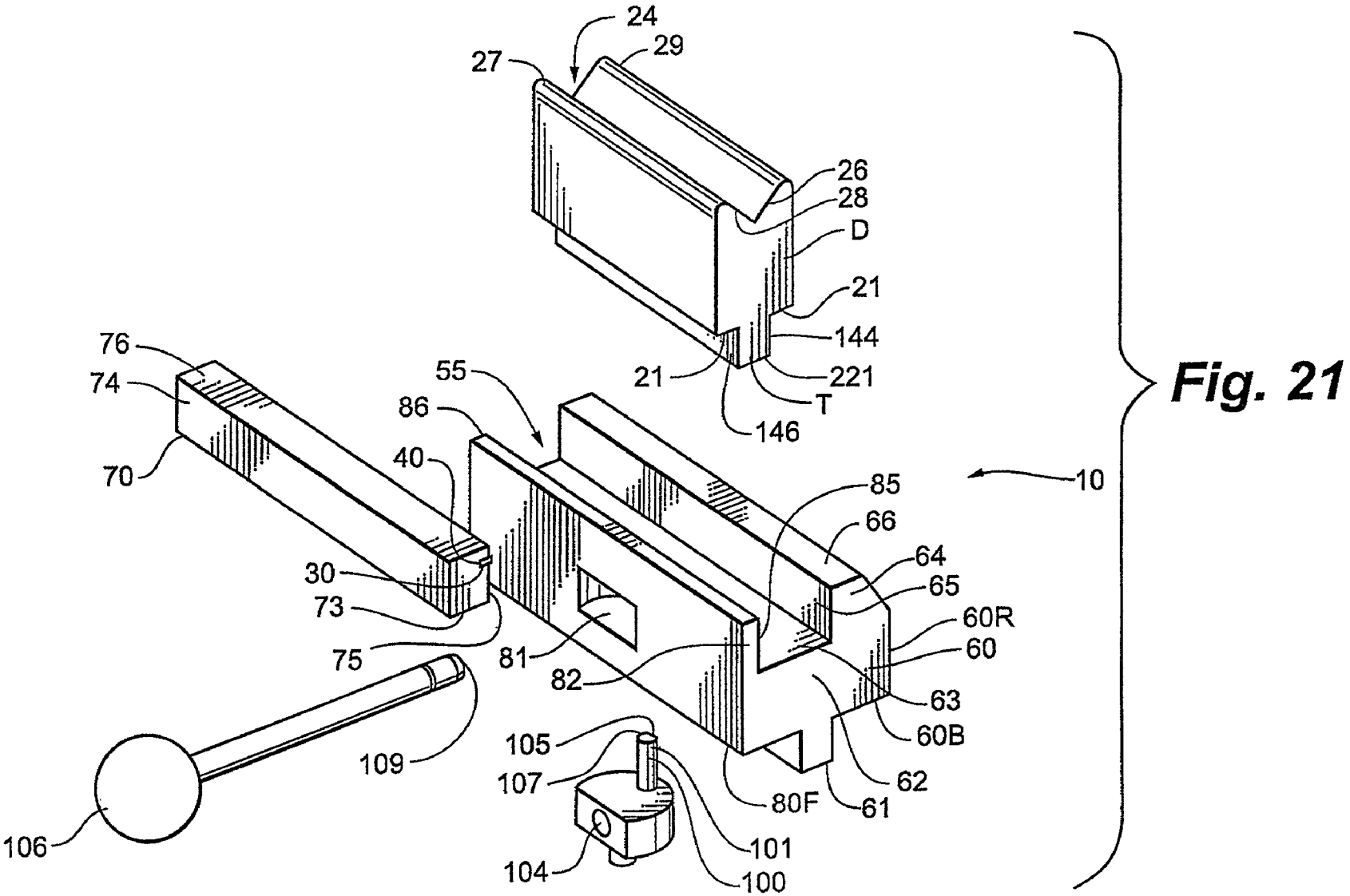
FIG. 21 is an exploded perspective view of the die holder and die of FIG. 20.
Figure 22:
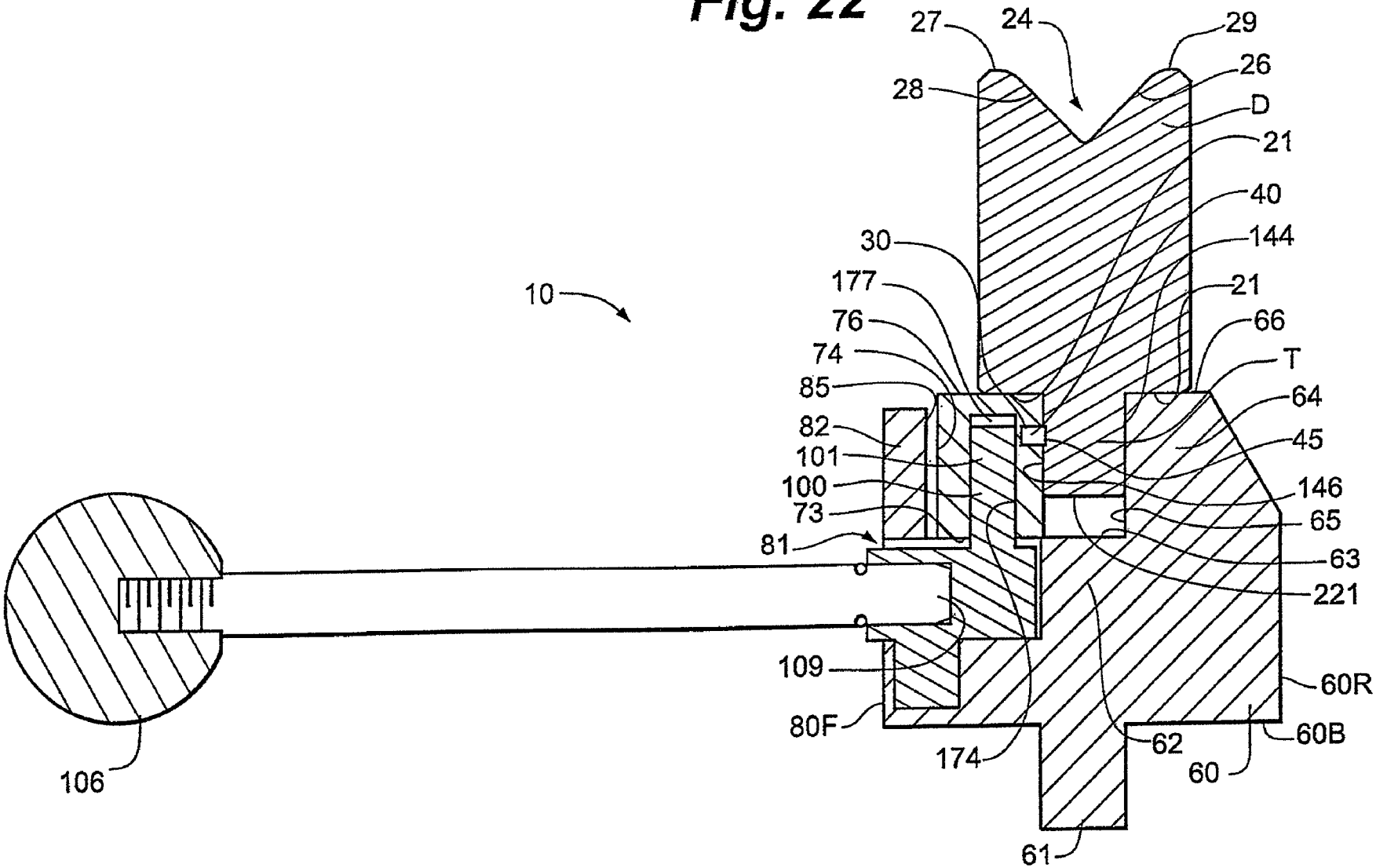
FIG. 22 is a schematic cross-sectional view of the die holder and die of FIG. 20.
Figure 23:
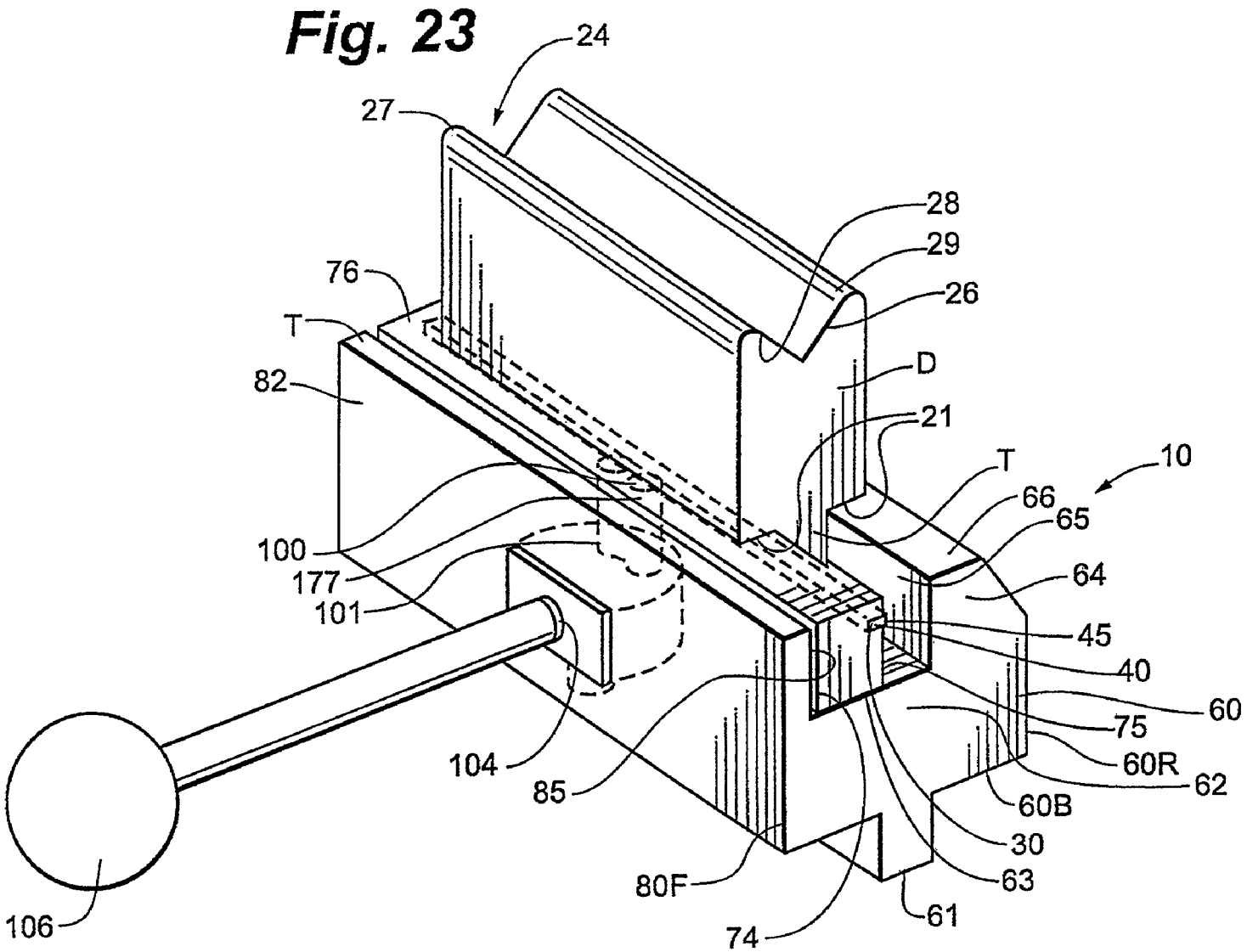
FIG. 23 is a schematic perspective view of the die holder and die of FIG. 20.

FIG. 19 depicts another useful cam member design. Here, the cam member 100 can have the same shape as the cam members 100 shown in FIGS. 1-8B. In FIG. 19, though, the locking bar 70 comprises two elongated bars (both desirably being metal or another rigid material) carried against each other. One of these bars defines the locking bar's rear wall 74, while the other bar defines the locking bar's clamping wall 75. Other multi-part locking bar designs can be used as well.

The die holder's first shoulder 82 can optionally have a vertically-extending generally-cylindrical opening 119 in which a cam member 100 is rotatably received. Reference is made to FIGS. 3 and 19.

In some preferred embodiments, the cam member 100 is adapted to be nested within (or is nested within) an opening 119 defined by the die holder's first shoulder 82. FIGS. 1-8B and 19, for example, depict embodiments wherein a wall section 89 of the die holder's first shoulder 82 surrounds more than 180 degrees of the cam member's head portion 101. Perhaps more preferably, this wall section 89 surrounds more than 240 degrees (optionally more than 270 degrees) of the cam member's head portion 101. In some embodiments, this surrounding extent of the wall section 89 is measured in a horizontal cross section that also passes through the head portion 101 of the cam member 100. This is perhaps best appreciated by referring to FIG. 6.

The die holder 10 in FIGS. 1-8B has a first shoulder 82 defining a plurality of cavities 119 in which respective cam members 100 are received. Each cam member 100 is adapted to be rotated in such a way that a portion of the rotating cam member (e.g., a wall section 107 thereof) is caused to protrude from an inner wall 85 (e.g., from a cavity 119 that opens through the inner wall 85) of the first shoulder 82 and cam with the locking bar (e.g., with a rear wall 74 of the locking bar), thereby forcing the locking bar to move toward the die holder's second shoulder 64.

In FIGS. 1-8B, 18-23, and 26, an outer wall (i.e., a wall facing away from the channel) of the die holder's first shoulder 82 has a cam-access opening (or "window") 81 through which one end 109 of a manually-operable handle 106 can be passed when inserting the end 109 of the handle into a cavity 104 in the side of the cam member 100. In the illustrated embodiments, the outer wall (e.g., a vertical cross section thereof) of the first shoulder 82 entirely surrounds each cam-access opening 81. This contributes to the particularly stable manner in which the illustrated cam members are nested in the wall.

The die holder 10 in FIGS. 1-8B has a plurality of spaced-apart cam-access openings 81. This, however, is not required in other embodiments.

FIG. 3 provides a fairly detailed view of one exemplary cam member 100 that can be used. This cam member 100 has a first exterior wall section 105 that is generally planar, and a second exterior wall section 107 that is convex. The convex wall section here is contiguous to the generally planar wall section, although this is not required. To initiate the die holder's camming action, the cam member 100 is rotated from a first configuration (shown in FIG. 8A), where the generally planar wall section 105 directly faces the locking bar 70, to a second configuration (shown in FIG. 8B), where the convex wall section 107 directly faces and bears forcibly against the locking bar. As noted above, the cam member 100 in FIG. 19 can have the same shape (e.g., the same wall sections 105, 107, head 101, and neck 102) as the cam members 100 shown in FIG. 3. It can also rotate (so as to cam with the locking bar) in the same manner described above for the cam members 100 in FIG. 3.

The cam member 100 can optionally have a major diameter and a minor diameter. (A major diameter, of course, is greater than a minor diameter.) In embodiments like those of FIGS. 3, 19, and 20-23, the minor diameter is perpendicular to the generally planar wall section 105, and the major diameter is perpendicular to the convex wall section 107. The major diameter may be greater than the minor diameter by, for example, at least 1/36 inch, or by at least 1/18 inch.

Thus, in the embodiments of FIGS. 1-8B, a plurality of cam members 100 are received in respective cavities 119 spaced-apart along a length of the die holder's first shoulder 82. Each illustrated cam member 100 has an opening 104 into which one end 109 of a manually-operable handle 106 can be inserted, as noted above. In these embodiments, each cam member 100 can be caused to cam with the locking bar 70 by inserting the end 109 of the handle 106 into the cavity 104 in such cam member and then moving the handle in a horizontal manner (see FIGS. 8A, 8B).

In the embodiments described above, the die holder includes a camming actuator unit. Some of the related drawings show embodiments wherein this camming actuator unit is adapted for being (or is) attached removably to the die holder's base. This, however, is not required. For example, some embodiments involve the camming actuator unit being adapted for removable attachment to another component of the die holder, to the lower table of a press brake, or to an adaptor or other mounting structure used to secure the die holder on the lower table of a press brake. Further, some embodiments involve the camming actuator unit being permanently attached to (e.g., being built into a block integral to) the die holder's base (FIGS. 18-23), to another component of the die holder, to the lower table of a press brake, or to an adaptor or other mounting structure used to secure the die holder on the lower table of a press brake.

In the exemplary embodiments of FIGS. 1-8B, the first shoulder 82 of the die holder is part of a manually-operable camming actuator unit attached removably to the die holder's base 62. In some embodiments of this nature, the die holder 10 is also provided with a hydraulically-operable actuator unit adapted for being attached removably to the die holder's base 62 (i.e., once the manually-operable camming actuator unit has been removed from the base). In these embodiments, when the hydraulic actuator unit HOA is operably connected to the die holder's base 62, the die holder can be operated such that, in response to delivering a sufficient pressure of hydraulic fluid into a hydraulic line HL of the actuator unit HOA, at least one moveable body MB (optionally carried by an inner wall 85 of the actuator unit HOA) bears forcibly against the locking bar 70 and thereby moves the locking bar toward the second shoulder 64 of the die holder.

Thus, in some embodiments, the die holder 10 is provided with (e.g., is part of a combination including) both a mechanically-operable actuator unit MOA and a hydraulically-operable actuator unit HOA. Preferably, the two units MOA, HOA are separate components that can be selectively attached to the die holder (e.g., to the die holder's base 62). In combination embodiments of this nature, both actuator units MOA, HOA may be packaged or otherwise bundled together (optionally with the blocks 60, 80, locking bar 70, and/or other components) and/or delivered/transported to a customer together.

In FIGS. 1, 2, 9, and 10, it can be appreciated that the illustrated die holder 10 can be used selectively with either a manually-operable actuator unit MOA or with a hydraulically-operable actuator unit HOA. In more detail, the die holder 10 in these embodiments is adapted for conversion (i.e., it is convertible) between a first operatively-assembled configuration (exemplified in FIG. 1) that includes the manually-operable actuator unit MOA and a second operatively-assembled configuration (exemplified in FIG. 9) that includes the hydraulically-operable actuator unit HOA.

Convertible die holder embodiments are advantageous in that they can be readily changed from being manually actuatable to being hydraulically actuatable, or vice versa. Thus, a press brake operator can assemble the die holder one way to allow for manual clamping and another way to allow for hydraulic clamping.

In some convertible die holder embodiments, the die holder 10 comprises a base 62, a shoulder 64, a locking bar 70, a rigid fastening system 400, and a resilient fastening system 300. This group of components can be provided in a combination/embodiment that does not actually include either or both actuator units, although one of them would, of course, be used during operation.

In the present embodiments, a block (optionally a single, integral block) 60 defines base 62 and shoulder 64. As is perhaps best seen in FIG. 10, the base 62 and shoulder 64 together may have a generally L-shaped configuration, although this is not required. Shoulder 64 preferably has a clamping wall 65. The locking bar 70 (described above) preferably has a clamping wall 75 as well.

The convertible die holder preferably includes a rigid fastening assembly 400 that can (i.e., is adapted to) rigidly attach the block 60 (optionally the base 62), as desired, either to the manually-operable actuator unit MOA (optionally to a lower portion thereof) or to the hydraulically-operable actuator unit HOA (optionally to a lower portion thereof). The convertible die holder preferably also includes a resilient fastening assembly 300 that can (i.e., is adapted to) resiliently attach the locking bar 70, as desired, either to the manually-operable actuator unit MOA (optionally to an upper portion thereof) or to the hydraulically-operable actuator unit HOA (optionally to an upper portion thereof).

When provided, the rigid fastening system 400 preferably includes a plurality of fastener openings 402 defined by the base 62 and configured to be alignable, as desired, either with corresponding openings 403 in the lower portion of the manually-operable actuator unit MOA or with corresponding openings 403 in the lower portion of the hydraulically-operable actuator unit HOA. Preferably, the rigid fastening system 400 also includes a plurality of rigid fasteners 405 each adapted to be extended through one of the fastener openings 402 defined by the base 62 and into an aligned one of the corresponding openings 403 in, as desired, either the lower portion of the manually-operable actuator unit MOA or the lower portion of the hydraulically-operable actuator unit HOA. The fasteners 405, for example, can be cap screws (e.g., socket head cap screws), such as M8-1.25 socket head cap screws. This example, of course, is by no means limiting, as other fasteners can be used.

The resilient fastening system 300, when provided, preferably includes a plurality of fastener openings 303 defined by the locking bar 70 and configured to be alignable, as desired, either with corresponding openings 302 in the upper portion of the manually-operable actuator unit MOA or with corresponding openings 302 in the upper portion of the hydraulically-operable actuator unit HOA. Preferably, the resilient fastening system 300 also includes a plurality of fasteners 305 each coupled with a spring member 307 and each adapted to be extended through one of the openings 302 in, as desired, either the upper portion of the manually-operable actuator unit MOA or the upper portion of the hydraulically-operable actuator unit HOA and into an aligned one of the fastener openings 303 in the locking bar 70. The fasteners 305, for example, can be shoulder bolts, such as M8×16 mm shoulder bolts with an M6 thread. Music wire gage springs can be used as the spring members 307. Other fasteners and springs can be used, of course, as these examples are by no means limiting.

Figure 9:
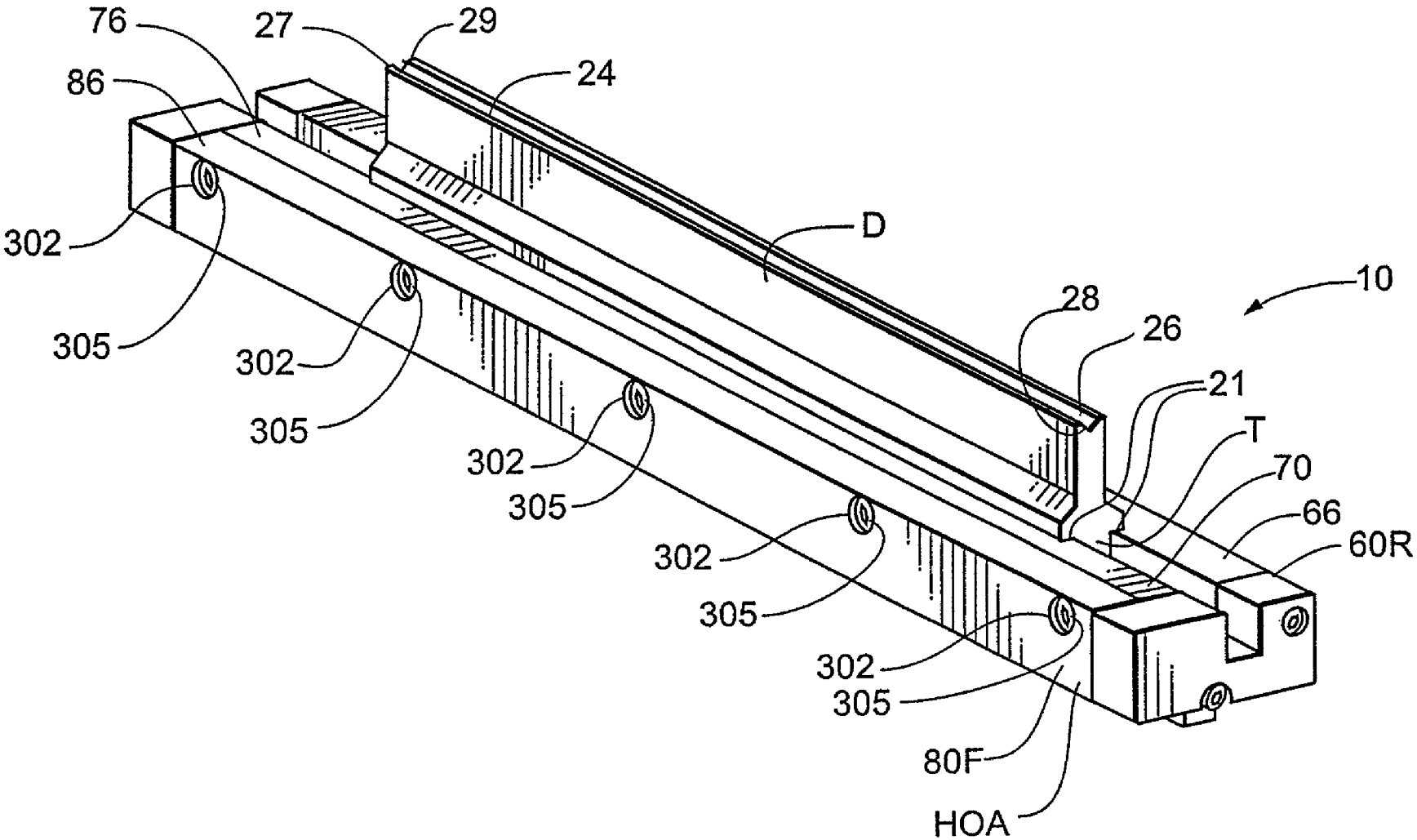
FIG. 9 is a perspective view of a die holder on which is mounted a die in accordance with other embodiments of the invention.
Figure 10:
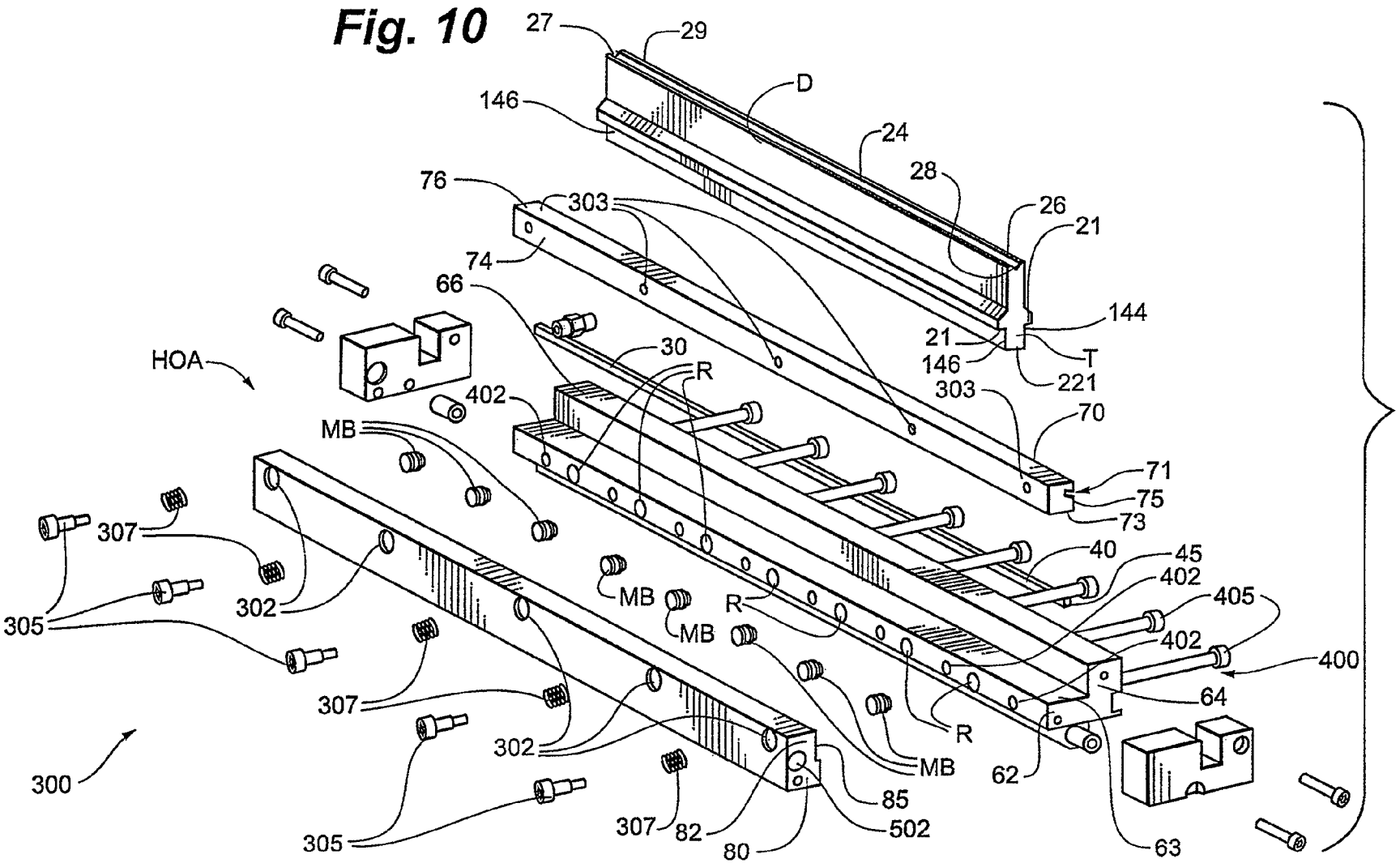
FIG. 10 is an exploded perspective view of the die holder and die of FIG. 9.
Figure 11:
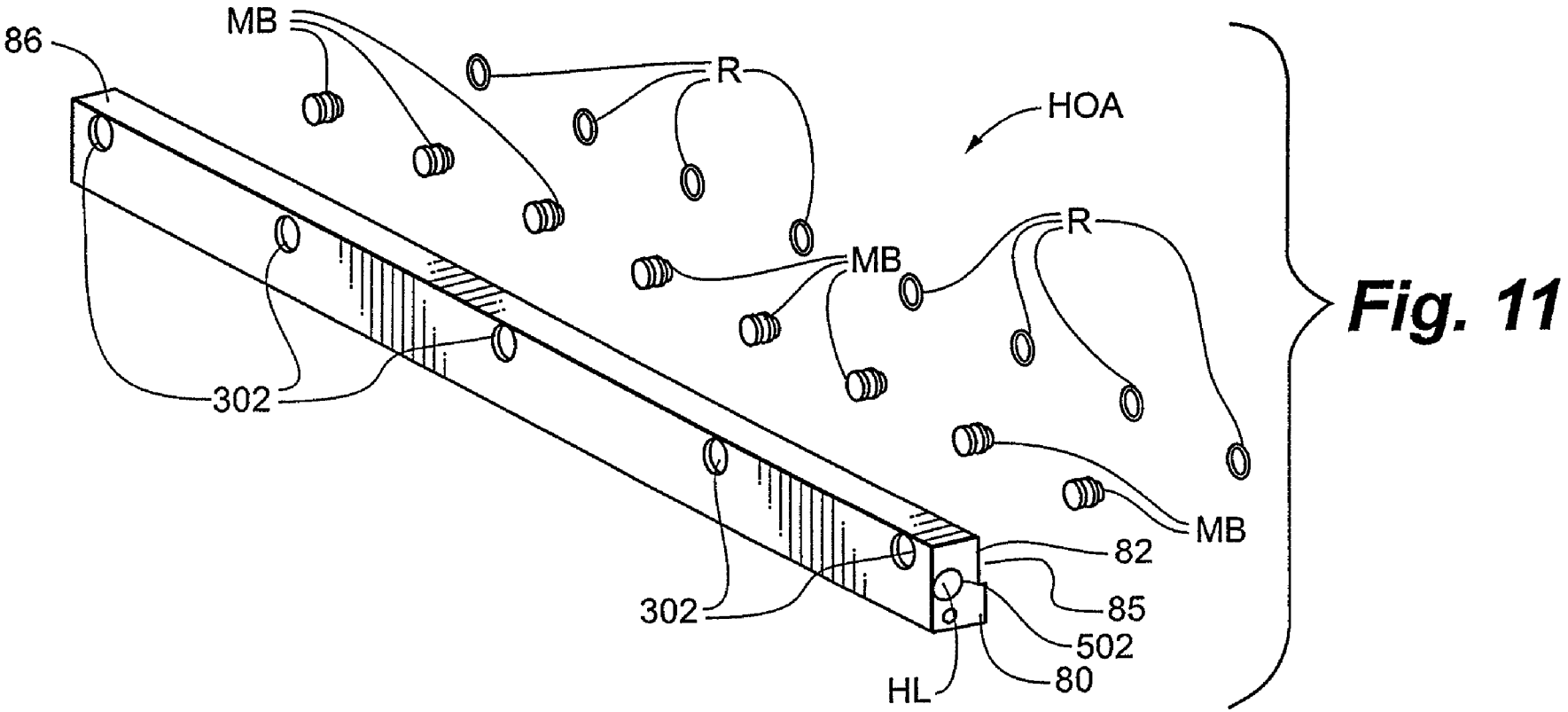
FIG. 11 is an exploded perspective view of a hydraulically-operable actuator unit that is provided in certain embodiments of the invention.
Figure 12:
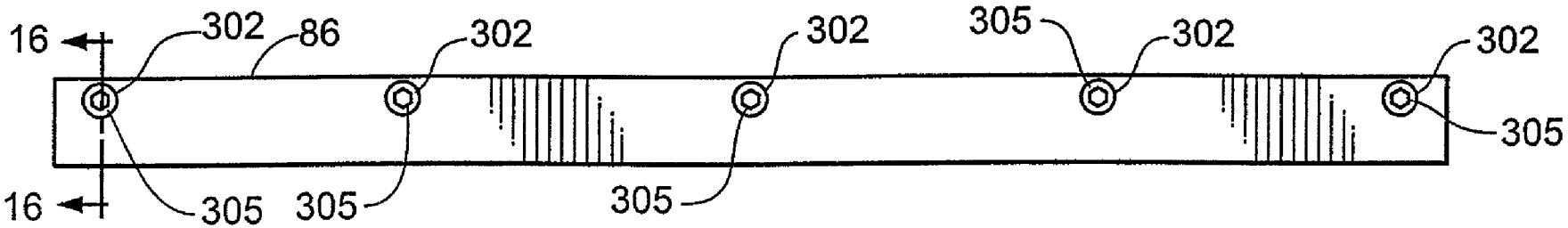
FIG. 12 is a front view of the hydraulically-operable actuator unit of FIG. 11.
Figure 13:
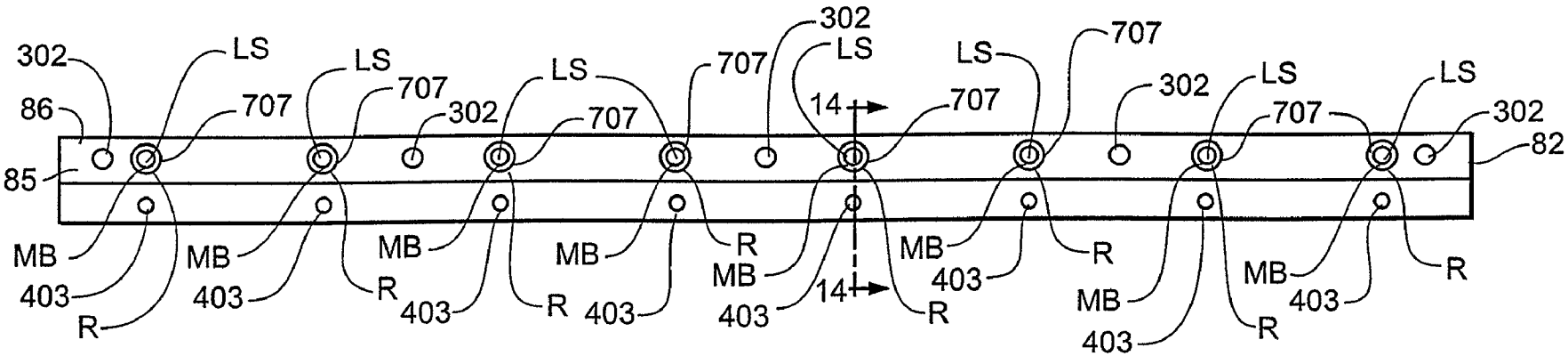
FIG. 13 is a back view of the hydraulically-operable actuator unit of FIG. 11.

FIGS. 9-14 show one example of a hydraulic actuator unit HOA. In FIG. 9, the hydraulic actuator unit HOA is operably connected to the base 62 of the die holder 10. Here, the die holder's first shoulder 82 is part of the hydraulic actuator unit HOA. This shoulder 82 is defined by a block 80, which in the present embodiments preferably is not integral to (i.e., is a different body than) the block 60 comprising the die holder's base 62 and second shoulder 64. Here again, the block 80 preferably is formed of metal or another rigid material. For example, P20 grade prehard material with a hardness of 28-32 and nitrided surface treatment to a 70 HRC can be used. Of course, other materials can be used, and this example is by no means limiting.

In the present figures (as well as in FIGS. 1-8B, 15A-17, and 24-26), block 80 is adapted for being removably attached to block 60. These blocks 60, 80 can be removably attached to each other in different ways. As noted above, one option involves a plurality of fasteners 405 that can be extended through respective openings 402 in the die holder's base 62 and into corresponding openings 403 in block 80. More generally, though, it should be appreciated that many different removable fastening systems can be used.

When the convertible die holder is in its second operatively-assembled configuration, the hydraulic actuator unit HOA preferably can be operated such that, in response to delivering a sufficient pressure of hydraulic fluid into a hydraulic line HL of the actuator unit HOA, at least one moveable body MB (optionally carried by the actuator unit HOA) bears forcibly against the locking bar 70, thereby moving the locking bar toward the die holder's second shoulder 64. In some cases, the locking bar 70 is resiliently biased toward the hydraulic actuator unit HOA (e.g., toward block 80) such that the locking bar is held resiliently against the hydraulic actuator unit (e.g., against inner surface 85 of block 80) unless a sufficient pressure of hydraulic fluid is delivered into the hydraulic line HL.

In some of the present embodiments, the hydraulic actuator unit HOA includes a plurality of hydraulically-actuated moveable bodies MB that (when the actuator unit HOA is operatively assembled with the die holder) are adapted to move (optionally in a plane that is generally or substantially horizontal) toward the die holder's channel 55 (i.e., when actuated). Thus, the moveable bodies (e.g., pistons) MB of the hydraulic actuator unit HOA may move directly toward the channel 55 in a horizontal direction in response to delivery of sufficient hydraulic fluid into the hydraulic actuator unit. In some of these embodiments, the moveable bodies MB do not bear directly against the die's tang T during clamping, but rather are adapted to bear against a locking bar 70, which then bears against the die's tang to deliver the die holder's clamping force.

Figure 14:
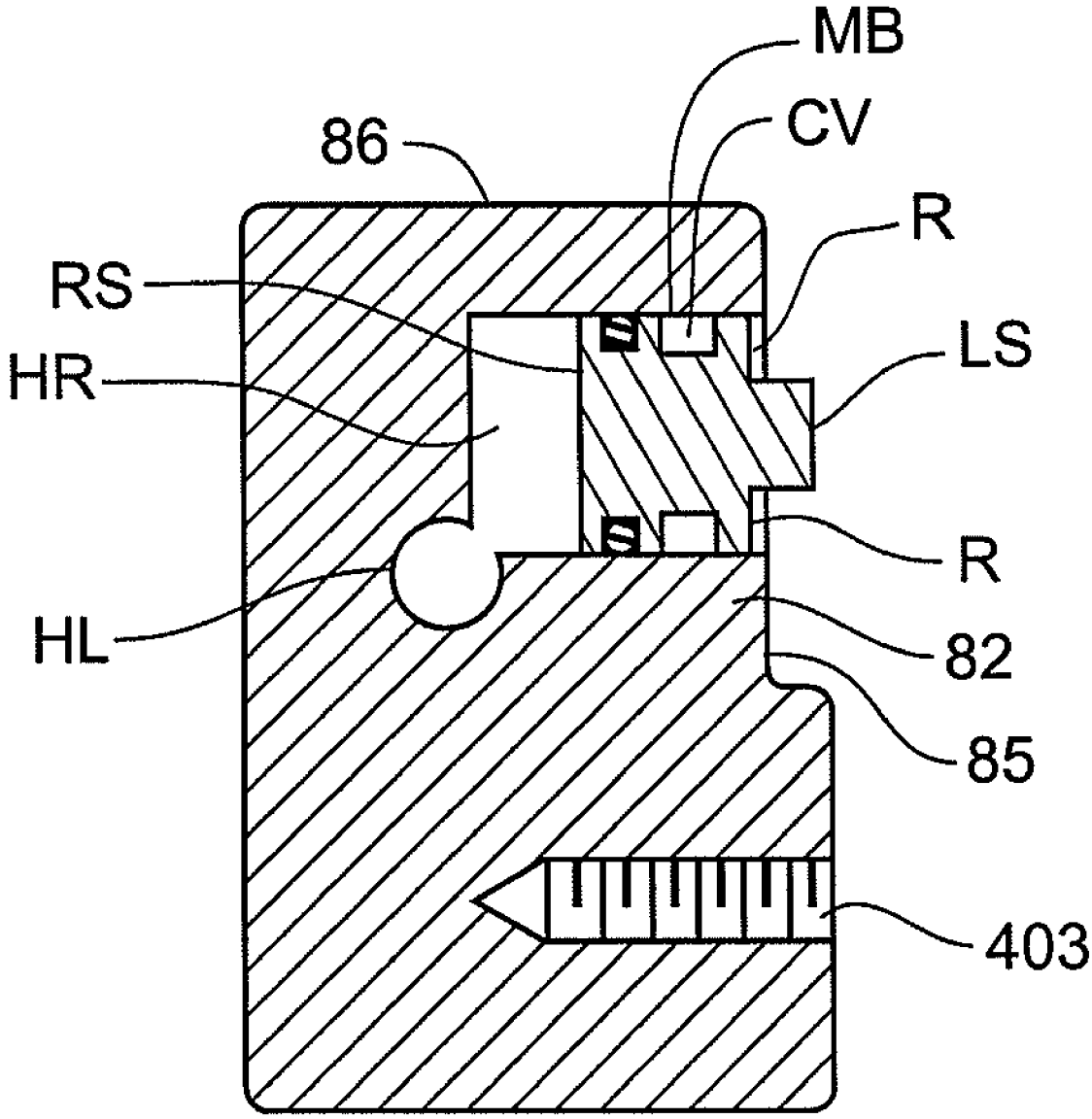
FIG. 14 is a cross-sectional view of the hydraulically-operable actuator unit of FIG. 13 taken along lines 14-14.

FIG. 9 depicts a hydraulic actuator unit HOA operably connected to the base 62 of the die holder. Here, a hydraulic line HL extends through block 80. The hydraulic line HL can optionally extend along an axis lying in a horizontal plane that passes through the die holder's channel 55 (and/or through clamping walls 65, 75), although this is by no means required. In some embodiments, the hydraulic line HL is defined by the block 80 itself (e.g., by a metal wall thereof). These embodiments avoid having (i.e., are devoid of) a resilient bladder, hose, or tube defining the hydraulic line. When it is desired to initiate the die holder's clamping action, hydraulic fluid (e.g., oil) is delivered through the hydraulic line HL and into a plurality of hydraulic reservoirs HR defined by block 80 (e.g., by a metal wall thereof). Reference is made to FIG. 14. The hydraulic fluid then bears forcibly against moveable bodies (such as pistons) MB that are in fluid communication with the hydraulic fluid in the reservoirs HR. This causes each moveable body MB to move toward an extended position (exemplified in FIG. 14). As the bodies MB move to their extended positions, they bear forcibly against the locking bar 70, thus forcing the locking bar to move toward the die holder's second shoulder 64.

In FIG. 14, block 80 defines a cavity CV in which the illustrated moveable body MB is disposed. One part of the cavity CV receives the moveable body MB, while another part of the cavity serves as the hydraulic reservoir HR. The illustrated moveable body MB carries an O-ring and is retained in the cavity CV by virtue of a ring R. These features, however, are merely exemplary.

In FIGS. 9-13, the hydraulic actuator unit HOA includes a plurality of moveable bodies MB. These moveable bodies MB are spaced-apart along the length of the die holder's first shoulder 82. In other embodiments, though, a single moveable body may be provided.

Thus, in embodiments like those of FIGS. 9-13, the die holder's clamping action results when a plurality of moveable bodies (optionally piston-like moveable bodies) MB are forced hydraulically to move from retracted to extended positions. (In the process, the bodies MB may move toward the direction of the die holder's channel 55). The extended position of one exemplary body MB is shown in FIG. 14. Here, the moveable body MB has a rear wall RS against which hydraulic fluid bears forcibly when the hydraulic actuator is operated. In more detail, when hydraulic pressure in the reservoir HR reaches a sufficiently high level, the moveable body MB is forced to slide to its extended position. As the body MB moves in this manner, a leading wall LS of the moveable body MB bears forcibly against the locking bar 70 (e.g., against wall 74), thereby causing the locking bar to move toward the die holder's second shoulder.

Thus, certain embodiments provide a rigid block 80 that defines the first shoulder 82 of the die holder, where a hydraulic line HL is built into the rigid block 80, where a moveable locking bar 70 is located between the first shoulder 82 and the die holder's channel 55, where a plurality of moveable bodies (optionally pistons) MB carried by the block 80 are adapted to move to extended positions (in the process bearing forcibly against the locking bar 70 and moving it toward the die holder's second shoulder 64) in response to delivery of a sufficient pressure of hydraulic fluid through the hydraulic line HL in the rigid block 80 (which is part of a hydraulic actuator unit). May different embodiments of this nature can be provided.

Preferably, the locking bar 70 is resiliently biased toward the die holder's first shoulder 82 such that, when the moveable bodies MB are in their retracted positions, the locking bar is held resiliently against the first shoulder 82. Thus, the locking bar 70 may have a default position in which it is held against the die holder's first shoulder 82 unless the hydraulic actuator unit HOA is operated (or the resilient bias on the locking bar is otherwise overcome). Thus, the die holder can have a fully-open default configuration, which can facilitate due positioning.

Thus, certain embodiments of the invention provide two rigid walls (e.g., block 80 and bar 70) located side-by-side, where both of these walls are located on the same side of the die holder's channel 55 while another rigid wall (e.g., shoulder 64) is located on an opposite side of the channel 55. In embodiments of this nature involving a hydraulic actuator unit HOA, of the two side-by-side blocks, the one (e.g., block 80) furthest from the channel 55 preferably is part of the actuator unit HOA while the one (e.g., bar 70) closest to the channel 55 preferably is caused to move (e.g., toward the rigid wall on the opposite side of the channel) in response to hydraulically-actuated movement of a plurality of moveable bodies (e.g., pistons) MB carried by that one of the two side-by-side blocks furthest from the channel.

Some embodiments of the invention provide a press brake die holder 10 having a die-contact body 30 that delivers a downward force to the tang T of a die D when the tang is positively clamped by the die holder. This downward force urges the tang T downwardly toward a base 62 of the die holder. (As noted above, the base 62 typically extends between the confronting clamping walls 65, 75 of the die holder.) Embodiments of this nature are advantageous in that the downward force, or "die-pulling force", tends to offset any bow, twist, or camber of the die. This die-pulling force is also advantageous in that it helps pull down the sectional pieces when the die holder is used to clamp sectional tooling.

In some of the present die-pulling embodiments, the die holder 10 has a height (from bottom surface 60B to top surface 66) of less than 4 inches, less than 3 inches, or less than about 2.6 inches. Additionally, the die holder's width (from surface 80F to surface 60R) can optionally be within any of the width ranges noted herein.

Preferably, the die holder 10 is adapted to deliver the downward force to the tang even when the tang's opposed clamping surfaces 144, 146 consist of (i.e., simply are) parallel planar surfaces. Exemplary tangs T of this nature are shown, for example, in FIGS. 2, 10, and 21-23. During positive clamping of the die's tang T between the two confronting walls 65, 75, the die-contact body 30 preferably delivers the downward force as a frictional force. Some of the present embodiments involve both confronting walls 65, 75 carrying die-contact bodies 30 that are adapted to deliver the downward force. In embodiments of this nature, the die-contact bodies 30 can optionally be mounted on the confronting walls 65, 75 so as to have limited range freedom of movement relative to the confronting walls.

In some of the present embodiments, the die holder 10 includes a die-contact body 30 that is moveable between an upper position and a lower position. Here, the die-contact body 30 can be optionally be resiliently biased toward its upper position by a spring member 340. The die-contact body 30 preferably is exposed to (e.g., mounted next to) the die holder's channel 55, and preferably has a contact surface 350 (which can optionally be planar) that engages the tang T of a die D during the clamping action of the die holder.

Figure 24:
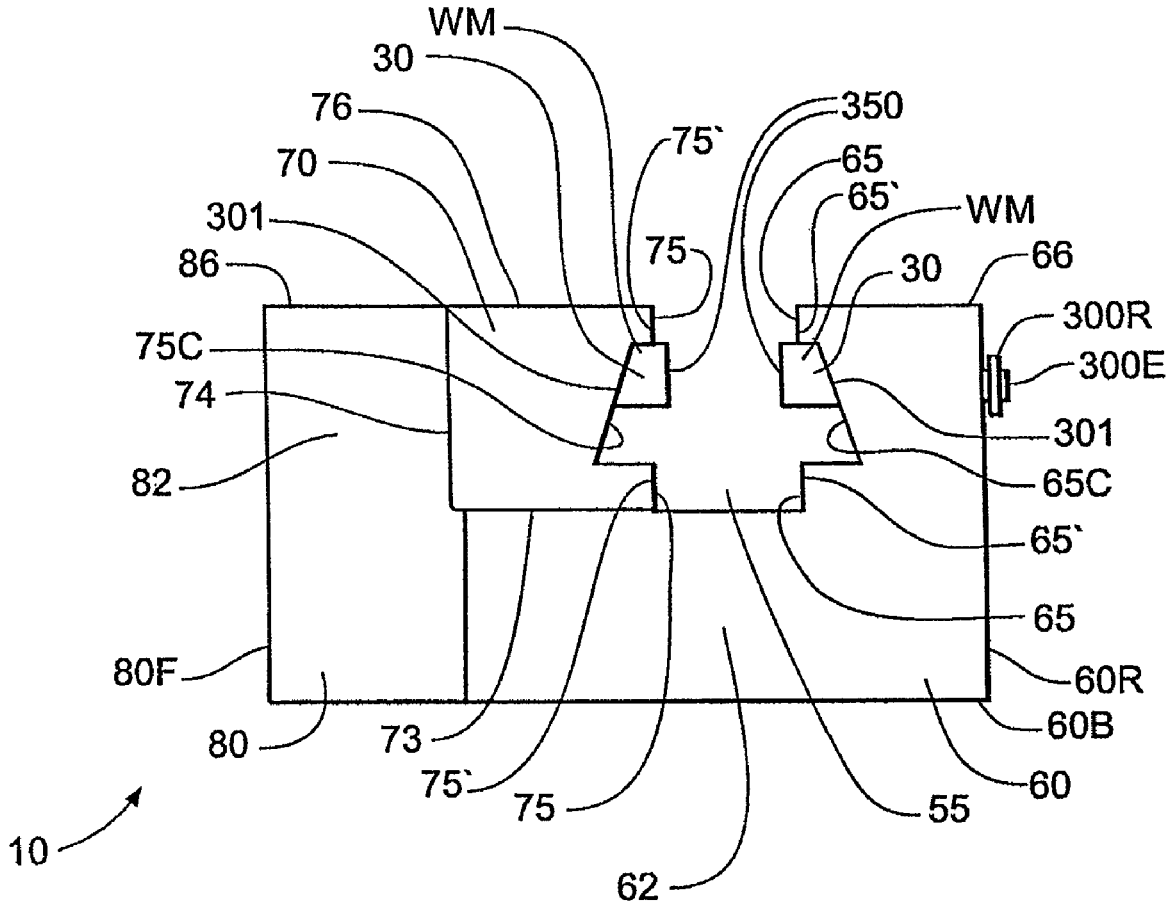
FIG. 24 is an end view of a die holder in accordance with certain embodiments of the invention.
Figure 25:
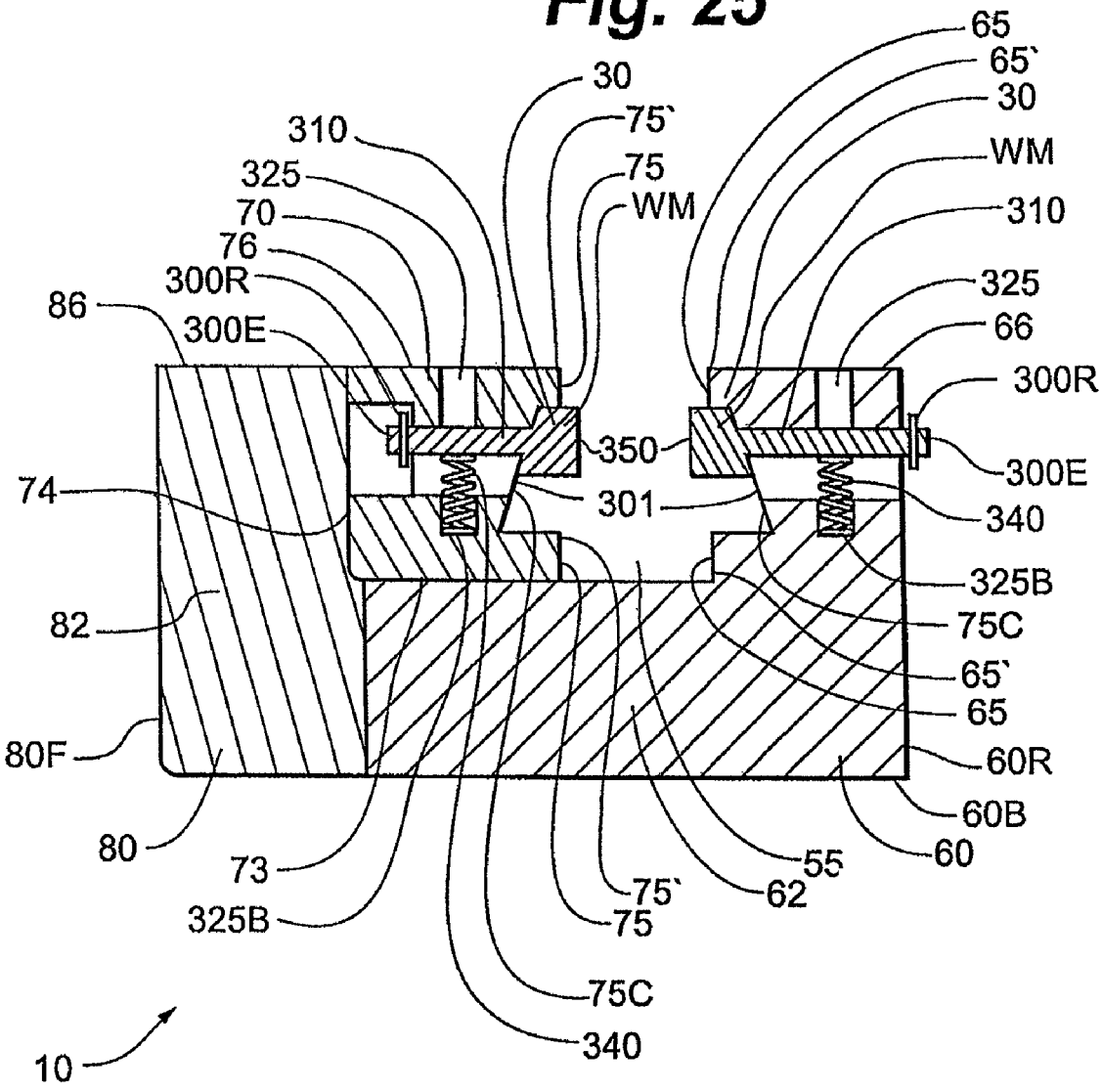
FIG. 25 is a cross-sectional view of the die holder of FIG. 24.

FIGS. 24 and 25 depict exemplary embodiments wherein the die-contact bodies 30 are wedge members WM. During positive clamping of the die's tang T between the die holder's two clamping walls 65, 75, the illustrated wedge members WM move downwardly (e.g., generally toward the die holder's base 62) relative to the clamping walls 65, 75. Here, each wedge member WM can optionally have a default position that is the highest position in such wedge member's limited range of motion. Each illustrated wedge member WM is held in this default position by a spring member 340 (which can be received, for example, in a bore 325B defined by block 60). When the tang T of a die D is positioned in the die holder's channel 55, and one of the confronting walls is moved toward the other confronting wall (so as to positively clamp the die's tang therebetween), the wedge members WM cam with corresponding cam surfaces 75C (shown as angled surfaces) of the die holder. This camming action causes the wedge members WM to move downwardly, while sliding along (i.e., camming with) the die holders' cam surfaces 75C. Preferably, this camming action continues at least until one or more loading surfaces 21, 221 of the die's tang T is/are pulled firmly against the die holder (e.g., at least until tang shoulder surfaces 21 engage die holder surfaces 66, 76, or at least until tang bottom surface 221 engages the die holder's base 62). This camming action between the wedge members WM and the die holder's cam surfaces 75C may continue (at the same time, the contact surfaces 350 of the wedge members WM may slide downwardly against the die's tang) for some time after one or more loading surfaces 21, 221 of the die's tang T is/are pulled firmly against the die holder. Perhaps optimally, this camming action ceases once planar vertical surfaces 65', 75' of the die holder's clamping walls 65, 75 clamp forcibly upon the die's tang T.

In the embodiments of FIGS. 24 and 25, a first group of wedge members WM are mounted on a locking bar 70, which is laterally moveable itself (i.e., toward and away from the die holder's second shoulder 64). Here, the wedge members WM of the first group project from the locking bar 70 into the channel 55, and the locking bar is located between the channel and the die holder's first shoulder 82. The die holder's first shoulder 82 is adapted to force (hydraulically, by camming, etc.) the locking bar 70 to move toward the die holder's second shoulder 64. Exemplary configurations, manners of lateral movement, etc., have been described for the locking bar 70.

When provided, the wedge member(s) WM can have many different configurations. In some cases, the contact surface 350 is oriented at an oblique angle relative to the wedge member's camming surface 301, which slides along cam surface 75C as the tang T of the die D is forcibly clamped by the die holder.

Each wedge member WM or other die-contact body 30 can optionally be formed of metal or another rigid material. In one group of embodiments, the die holder includes one or more die-contact bodies 30 each comprising (optionally having a portion comprising) polymer, perhaps together with a filler. One useful polymer is nylon, such as nylon 66. Torlon or ultra high molecular weight polyethylene may also be suitable. If desired, the polymer can comprise a filler, such as glass fibers. Nylon 66 with 20% glass filler may be suitable. The die-contact body 30 may, in some cases, consist essentially of any of the noted materials.

The invention provides some embodiments wherein a press brake die holder is provided with a resilient body 40 that engages the tang T of a die D when the die holder closes upon the die's tang. The resilient body 40 is another useful type of die-contact body 30. When provided, the resilient body 40 preferably is configured such that when the die holder closes upon the die's tang T, the resilient body delivers a net downward force to the tang. This downward force, or "die-pulling force", urges the die downwardly toward the base 62 of the die holder.

In the present embodiments (those involving a resilient body 40 or any other die-contact body 30), the die holder can take many different forms. It can have one of the designs disclosed above (a design with camming action on a locking bar, and/or a design convertible between manually and hydraulically actuatable states, etc.). More generally, it can have any die holder design that provides positive clamping.

The present embodiments involve a die holder with two confronting walls between which a die's tang can be positioned. At least one of the two walls (a "desired" one of the walls) is adapted for being moved toward the other wall, e.g., so as to positively clamp the tang when the tang is positioned between the two walls. In the present embodiments, the die holder is provided with a resilient body that delivers a net downward force to the tang during clamping (i.e., when the tang is positively clamped between the two walls). This net downward force urges the tang downwardly toward the die holder's base 62, which preferably extends between the two clamping walls of the die holder. This can be appreciated by referring to FIGS. 15A, 15B, and 17.

In some embodiments, the resilient body (or "plug") 40 is an elongated resilient bar extending lengthwise along the desired wall. Reference is made to FIGS. 1, 2, 10, and 23. Embodiments of this nature are advantageous, for example, because they enable the die holder 10 to clamp sectional tooling.

The resilient bar 40 has a face 45 that engages the tang T during clamping (i.e., when the tang is positively clamped between the walls 65, 75). Preferably, this face 45 is adapted to deliver a net downward force to the tang during clamping. To accomplish this, the resilient body 40 can have a variety of different configurations and orientations. For example, the resilient body 40 can be downwardly oriented and/or its face 45 can be downwardly angled (optionally forming an oblique angle with respect to one of the clamping walls, such as clamping wall 75). If desired, part (or all) of the face 45 may form an angle of at least 2 degrees, at least 3 degrees, or at least five degrees relative to the clamping wall 65, 75 on which it is carried. The face 45 may have a generally downwardly-facing plan or configuration (as shown), a generally downwardly-facing convex configuration, a generally downwardly-facing polygonal configuration, a generally downwardly-facing irregular configuration, etc. If desired, the entire face 45 (or substantially the entire face) can define a downwardly angled surface.

Figure 15A:
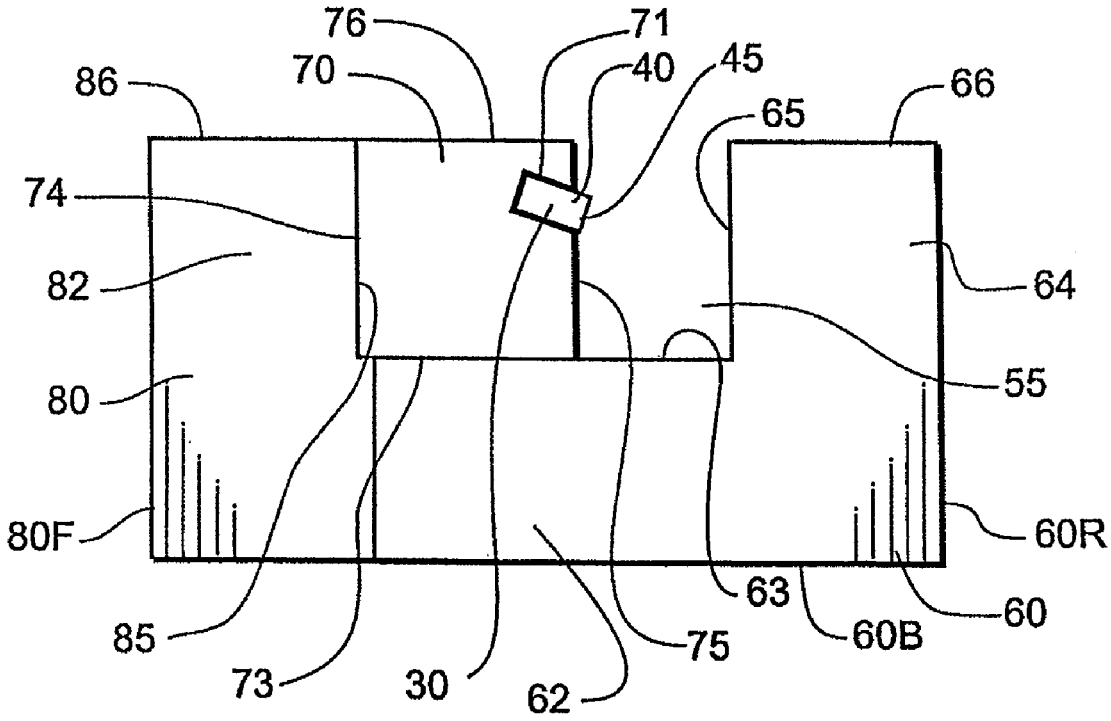
FIG. 15A is an end view of a die holder in accordance with certain embodiments of the invention.
Figure 15B:
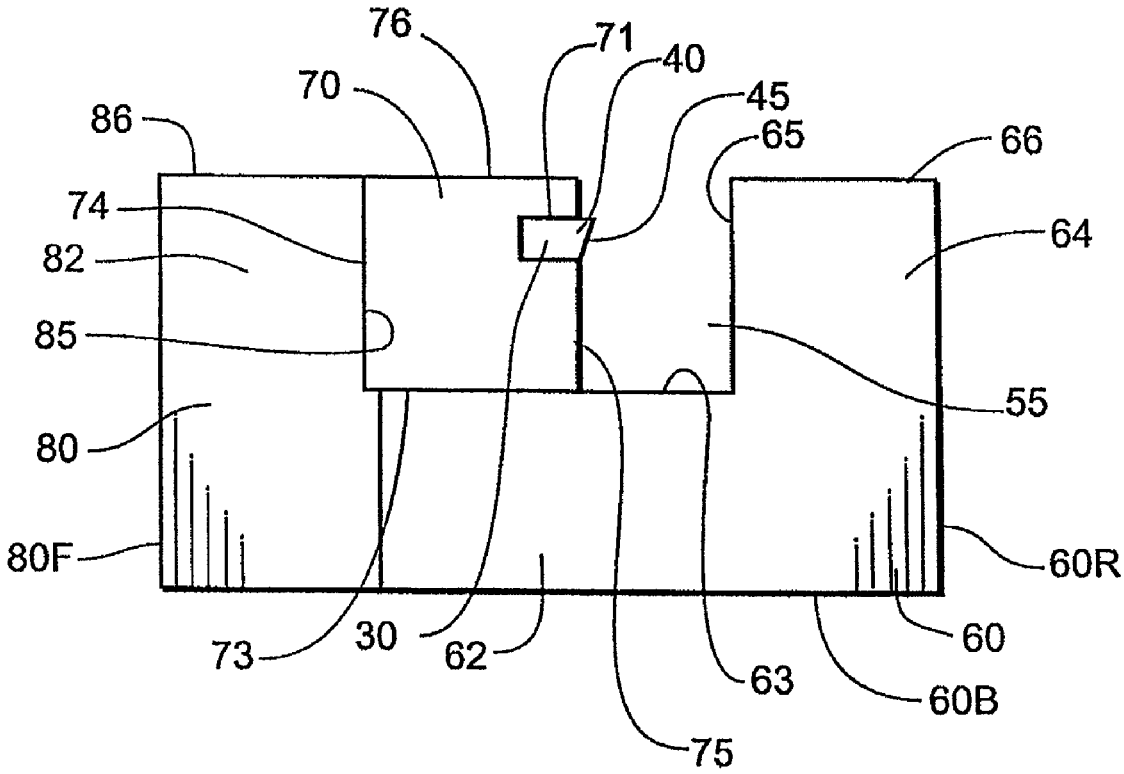
FIG. 15B is an end view of another die holder in accordance with certain embodiments of the invention.
Figure 16:
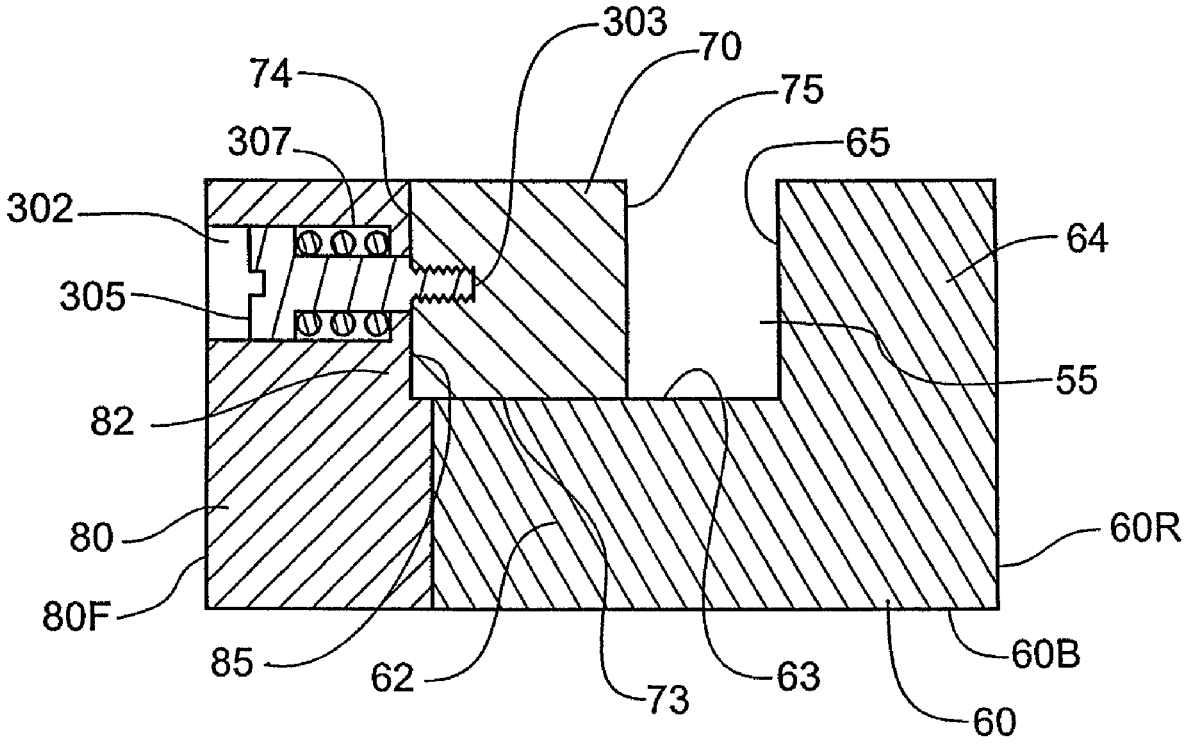
FIG. 16 is a cross-sectional view of the hydraulically-operable actuator unit of FIG. 12 taken along lines 16-16.
Figure 17:
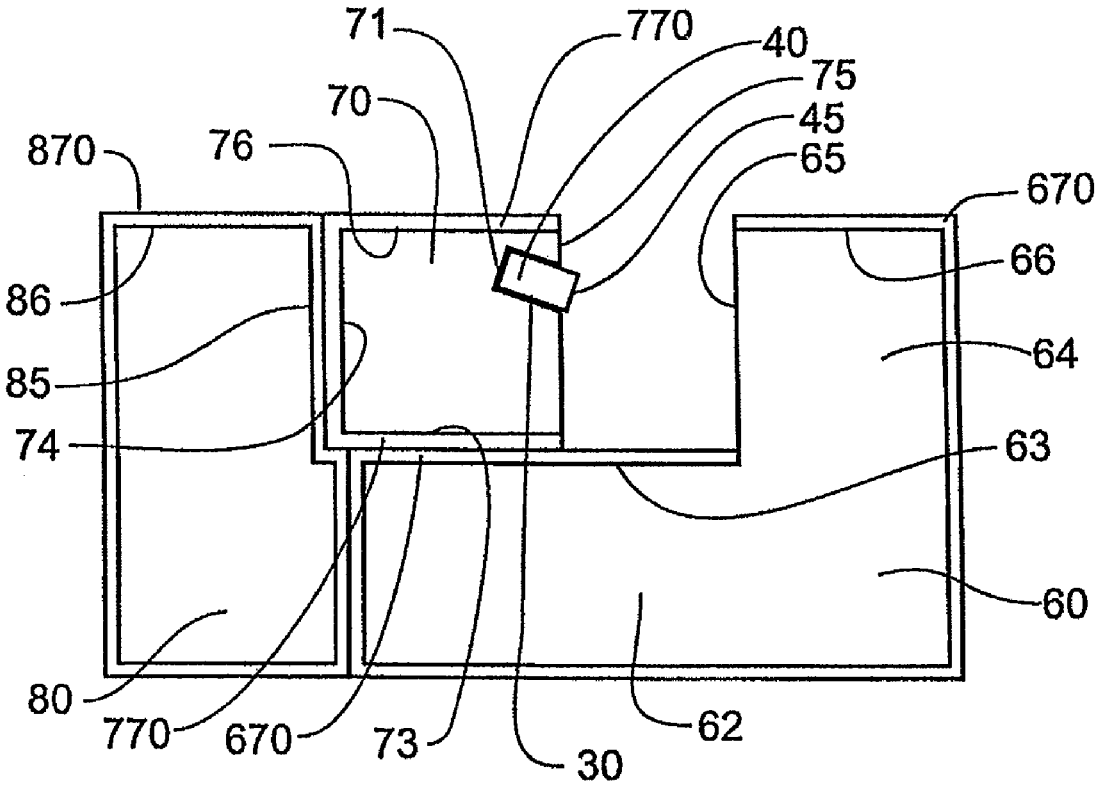
FIG. 17 is a schematic end view of a die holder in accordance with certain embodiments.

In certain embodiments, as shown in FIGS. 15A and 17, the downward orientation (e.g., downward angle) of the face 45 is achieved by mounting the resilient body 40 in a cavity 71 that opens (through a clamping wall/to the channel) in a downward and sideward direction. The cavity 71 is defined by one of the clamping walls (optionally by clamping wall 75). In FIGS. 15A and 17, the cavity 71 is downwardly and sidewardly angled from its closed end to its open end (which opens into the channel 55), so as to cause face 45 to be generally downwardly angled (or "downwardly and sidewardly angled"). Alternatively, the cavity 71 can extend horizontally through one of the clamping walls 65, 75, and the resilient body 40 can be shaped so as to have its face 45 generally downwardly angled (or "downwardly and sidewardly angled").

In connection with the term "net downward force", it is contemplated that, for some embodiments, when the resilient body is compressed during clamping, part of the body (e.g., an upper part) may deliver a small upward force component (e.g., frictional force), even though the overall vertical force will be downward (i.e., the downward force component will be greater than any upward force component).

The die holder 10 has an elongated configuration. Its confronting walls 65, 75, for example, commonly each have a length of at least 4 inches, or at least 5 inches. For embodiments involving an elongated resilient bar, the resilient bar desirably extends along at least 75% of the length of the wall on which it is carried. Perhaps most preferably, the resilient bar extends along the entire length (or substantially the entire length) of the desired wall. Embodiments of this nature are particularly advantageous, for example, in applications where the die holder is used to clamp sectional tooling.

As noted above, the resilient body 40 preferably is received in a cavity 71 formed by one of the confronting walls of the die holder. Part of the resilient body 40 protrudes outwardly from the cavity 71. It may be preferred that the resilient body 40 extend into the channel by a distance of between about 0.001 inch and about 0.015 inch. Thus, the resilient body protrudes into the channel 55 by a certain distance, and the width of the channel measured from the face 45 of the resilient body 40 to the confronting wall is therefore slightly less than the width of the channel measured between the clamping walls 65,75. This way, when the tang is positively clamped between the two walls, the resilient body compresses slightly.

In the illustrated embodiments, the cavity 71 that receives the resilient body 40 is a longitudinal cavity defined by the locking bar 70. Here, the cavity 71 is formed so as to open through the locking bar's clamping wall 75 and into the channel 55. The cavity 71 can be made using any convenient means, e.g., a Woodruff cutter. In the illustrated embodiments, the cavity 71 extends along the die holder's elongated direction (along the longitudinal axis of the die holder), that is, parallel to the channel 55.

As noted above, the resilient body 40 preferably protrudes into the channel 55 a sufficient distance to encounter and resiliently press against a confronting wall 146 of the die's tang T, thus urging the tang's other wall 144 into contact with the die holder's other clamping wall 65. The resilient body 40 may be a single length of material, such as a polyurethane elastomer, or it may comprise a plurality of discrete sections. Thus, although a single plug 40 is shown, two or more plugs can be used. Some embodiments involve at least one resilient body 40 carried by each of the two clamping walls 65, 75.

A variety of materials can be used for the resilient body 40. Polyurethane or other resilient polymers may be used. Thus, in some cases, the resilient body 40 comprises (or consists essentially of) polyurethane or another resilient polymer. In one group of embodiments, urethane is used. Thus, the resilient body 40 can optionally comprise, consist essentially of, or be formed of urethane.

The face 45 of the resilient body 40 that protrudes into the channel 55 can optionally have a hardness in the range of 60-95 Durometer A, such as a hardness in the range of about 85-90 Durometer A. Put another way, the resilient body 40 may be sufficiently resilient so its face 45 can be slightly dented by fingernail pressure.

In the illustrated embodiments, the resilient body 40 has an elongated bar shape. While this is advantageous, the resilient body 40 can have many different configurations. For example, it can take the form of a button, sphere, or the like. In such cases, the resilient body 40 preferably is configured to deliver a net downward force on the tang T of a die D during clamping.

If desired, an adhesive can be provided between the resilient body 40 and the cavity 71. This may be desired to prevent the resilient body 40 from escaping the cavity 71. Additionally or alternatively, the cavity 71 can be sized and/or shaped so as to grip and retain the resilient body 40 in the cavity 71 without any adhesive or other attachment means.

In some of the present embodiments, the die holder 10 has a first shoulder 82, a second shoulder 64, a base 62, and an elongated channel 55. In these embodiments, the resilient body may be carried by an elongated locking bar 70 (such that the "desired wall" is defined by the locking bar, and the "other wall" is defined by the second shoulder 64). As noted above, the locking bar 70 preferably is adapted for movement toward the second shoulder 64 so as to positively clamp the tang T of a die D. Thus, the locking bar 70 preferably has a clamping wall 75 facing the die holder's second shoulder 64, and this wall 75 preferably defines the cavity 71 in which the resilient body 40 is received. In other cases, though, clamping wall 65 defines the cavity 71. Either way, part of the resilient body 40 preferably protrudes from the cavity 71 into the channel 55 so as to be engageable with the tang T during clamping.

The invention also provides embodiments wherein coating features are incorporated into a press brake die holder. In these embodiments, the die holder can take many different forms. It may be one of the designs disclosed above (a design with camming action on a locking bar, and/or a design convertible between manually and hydraulically actuatable states, etc.). However, the present coating features can be incorporated into any press brake die holder. The coating features are particularly advantageous for die holders that offer positive clamping and have parts (e.g., walls) that slide against one another during clamping.

Generally, the die holder 10 of the present embodiments has a coating over at least one surface. In some cases, the coating is provided on a moveable surface (e.g., a surface that moves during clamping or unclamping) of the die holder.

Typically, the die holder 10 has a block 60 that includes a base 62 and a shoulder 64. The base 62 and shoulder 64 together may have a generally L-shaped configuration, as noted above. In some cases, the die holder 10 includes an elongated locking bar 70. When provided, the locking bar 70 preferably has a first clamping wall 75, while shoulder 64 preferably has a second clamping wall 65.

In the present embodiments, coating may be provided on one or more of the following surfaces: (1) the locking bar's bottom wall 73, which preferably is adapted to slide along the die holder's base 62 during clamping and unclamping; (2) an upwardly-facing surface 63 of the die holder's base; (3) one or each of the die holder's upwardly-facing loading surfaces 66, 76, along which loading surfaces 21 of certain types of dies D are adapted to slide (e.g., during positioning of the die when the die holder is unclamped).

In certain embodiments, the clamping wall 75 of the locking bar 70 is defined by uncoated metal. Additionally or alternatively, the die holder's second clamping wall 65 can be defined by uncoated metal. Such uncoated clamping wall features can be provided to reduce the likelihood of any slippage between the die's tang and the die holder's clamping walls. It is contemplated, though, that some embodiments may involve coatings on the clamping walls, perhaps high-friction-coefficient coatings that facilitate clamping.

In one group of embodiments, coating 770 is provided on the locking bar's bottom surface 73, coating 670 is provided on the die holder's base 60 (e.g., on an upwardly-facing surface 63), and on the die holder's upwardly-facing loading surfaces 66, 76. Perhaps ideally, coating 870 is also provided on block 80. Reference is made to FIG. 17.

When provided, the coating can optionally be a dry lubricant coating. For example, the coating can comprise nickel (e.g., nickel alloy) and/or a low friction polymer. In some cases, the coated surface has one or more of the following features: (i) a coefficient of static friction below 0.35, below 0.3, or even below 0.2; (ii) a coefficient of dynamic friction below 0.3, below 0.25, below 0.18, or even below 0.1. Useful dry lubricant coatings are available commercially from, for example, General Magnaplate Corporation (Linden, N.J., USA) and Poeton Industries, Ltd. (Gloucester, England). As one example, the coating can be a NEDOX® coating.

In some cases, the coating comprises a nitride and/or a carbide. One commercially available nitride coating is the Nitrex® coating, which is a high endurance surface enhancement available commercially from Nitrex, Inc. (Aurora, Ill., USA). Particularly useful nitriding and nitrocarburizing enhancements are described in U.S. Pat. No. 6,327,884, the salient teachings of which are incorporated herein by reference.

Nitriding and nitrocarburizing processes are known in the field and need not be described in great detail. Reference is made to U.S. Pat. Nos. 4,790,888 and 4,268,323, the teachings of which regarding such enhancements are incorporated herein by reference. The latter patent refers to the use of a fused salt bath to enable nitrogen and carbon to diffuse into the surface of a steel piece suspended in the bath to form a carbonitride case. Reference is made also to U.S. Pat. No. 5,234,721 (referring to methods of forming carbonitride coatings), the teachings of which regarding such coatings are incorporated herein by reference.

Nitriding processes, both plasma (ion) nitriding and liquid nitriding, are described in detail in the ASM Handbook prepared under the direction of the ASM International Handbook Committee, Revised vol. 4*: Heat Treating*, pp. 410-424 (1994), the teachings of which concerning nitriding enhancements are incorporated herein by reference. Plasma or ion nitriding involves the use of glow discharge technology to provide nascent nitrogen to the surface of a heated steel part. Here, the part is subjected to a nitrogen plasma in a vacuum chamber. Nascent nitrogen diffuses into the surface of the part to form an outer "compound" zone containing $\gamma(Fe_4N)$ and $\epsilon(Fe_{2,3}N)$ intermetallics, and an inner "diffusion" zone which may be described as the original core microstructure with some solid solution and precipitation strengthening. Liquid nitriding involves immersing a steel part in a molten, nitrogen-containing fused salt bath containing cyanides or cyanates, e.g., NaCN or NaCNO. Tool components can be enhanced by liquid nitriding through a wide variety of commercial coating manufacturers, such as Metal Treaters Inc. of St. Paul, Minn., USA. The term coating includes discrete coatings on the surface of a part, diffusion of material into the part so as to enhance its surface, etc.

While a preferred embodiment of the present invention has been described, it should be understood that various changes, adaptations and modifications may be made therein without departing from the spirit of the invention and the scope of the appended claims.

What is claimed is:

1. A press brake die holder for holding a die having an upper, workpiece-contact portion and a lower, elongated tang, the die holder having a first shoulder, a second shoulder, a base, and an elongated channel adapted to receive the tang of said die, the die holder further including an elongated locking bar adapted for movement toward the second shoulder of the die holder so as to positively clamp the tang when the tang is positioned in the channel, the first shoulder of the die holder carrying at least one cam member adapted to move so as to cause a camming action between the cam member and the locking bar, wherein this camming action causes said movement of the locking bar toward the second shoulder of the die holder.

2. The press brake die holder of claim 1 wherein the elongated locking bar has a rear wall facing the first shoulder of the die holder, wherein said camming action involves the cam member camming against the rear wall of the locking bar and thereby forcing the locking bar to move toward the second shoulder of the die holder.

3. The press brake die holder of claim 1 wherein said camming action results when the cam member is moved from a first configuration to a second configuration, the locking bar being closer to the second shoulder of the die holder when the cam member is in its second configuration than when the cam member is in its first configuration.

4. The press brake die holder of claim 1 wherein the cam member is adapted to rotate about a vertical axis to cause said camming action.

5. The press brake die holder of claim 4 wherein the cam member rotates about said vertical axis in response to horizontal movement of a manually operated handle, an end of which is removably received in the cam member.

6. The press brake die holder of claim 1 wherein the cam member has a generally-cylindrical configuration, the first shoulder of the die holder having a vertically-extending, generally-cylindrical opening in which the cam member is rotatably received.

7. The press brake die holder of claim 1 wherein the cam member has a head portion adapted to cam with the locking bar to provide said camming action, the cam member being nested within an opening defined by the first shoulder of the die holder such that a wall section of the first shoulder surrounds more than 180 degrees of the cam member's head portion.

8. The press brake die holder of claim 7 wherein, in a horizontal cross section extending through the head portion of the cam member, said wall section of the first shoulder surrounds more than 240 degrees of the cam member's head portion.

9. The press brake die holder of claim 1 wherein the cam member has a first exterior wall section that is generally planar and a second exterior wall section that is convex, said convex wall section being contiguous to said generally planar wall section, wherein to initiate said camming action the cam member is rotated from a first configuration where its generally planar wall section directly faces the locking bar to a second configuration where its convex wall section directly faces and bears forcibly against the locking bar.

10. The press brake die holder of claim 9 wherein the cam member has a major diameter and a minor diameter, the major diameter being greater than the minor diameter, the minor diameter being perpendicular to the generally planar wall section, the major diameter being perpendicular to the convex wall section.

11. The press brake die holder of claim 10 wherein the major diameter is greater than the minor diameter by at least 1/36 inch.

12. The press brake die holder of claim 1 wherein the first shoulder of the die holder carries a plurality of cam members each being adapted to move from a first configuration to a second configuration so as to cause said camming action between the cam member and the locking bar, wherein the locking bar is resiliently biased toward the die holder's first shoulder such that, when all the cam members are in their first configurations, the locking bar is held resiliently against the first shoulder.

13. The press brake die holder of claim 1 wherein the die holder includes a plurality of cam members received in respective openings spaced-apart along a length of the die holder's first shoulder, wherein each cam member has an opening into which an end of a manually-operable handle can be inserted, wherein each cam member can be made to cam with the locking bar by inserting the end of the handle into the opening in such cam member and then moving the handle in a horizontal manner.

14. The press brake die holder of claim 1 wherein at least one of the locking bar and the second shoulder has a cavity that opens into the channel, and wherein a resilient body is received in said cavity and protrudes into the channel, the resilient body having a die-seating configuration such that the resilient body is adapted to deliver a net downward force to the die's tang when the tang is positively clamped between the locking bar and the second shoulder, the net downward force urging the tang toward said base.

15. The press brake die holder of claim 14 wherein the resilient body is an elongated resilient bar, and wherein said cavity is an elongated cavity extending lengthwise along the locking bar or along the second shoulder, the resilient bar having a face that engages the die's tang when the tang is positively clamped between the locking bar and the second shoulder, said face being downwardly angled to provide the die-seating configuration.

16. The press brake die holder of claim 14 wherein the resilient body comprises a resilient polymer.

17. The press brake die holder of claim 14 wherein the resilient body is formed of urethane.

18. A combination comprising the press brake die holder of claim 1, wherein the first shoulder is a manually-operable camming actuator unit attached removably to said base, wherein the combination further includes a hydraulic actuator unit, the hydraulic actuator unit being adapted for removable attachment to said base if the manually-operable camming actuator unit is removed from the base, the hydraulic actuator unit including a hydraulic line and carrying at least one moveable body, wherein when the hydraulic actuator unit is operably connected to said base the hydraulic actuator unit can be operated such that, in response to delivering a sufficient pressure of hydraulic fluid into the hydraulic line of the hydraulic actuator unit, said at least one moveable body bears forcibly against the locking bar and thereby moves the locking bar toward the second shoulder of the die holder.

19. The press brake die holder of claim 1 wherein the die holder is adapted for said camming action to be initiated by a manual tool-free operation.

20. A method of delivering the combination of claim 18 to a customer, wherein the method involves both said manually-operable camming actuator unit and said hydraulic actuator unit being bundled together and transported to the customer.

21. The press brake die holder of claim 1 wherein the die is held by the die holder such that the tang of the die is received in the die holder's elongated channel and positively clamped between the locking bar and the second shoulder.

22. The press brake die holder of claim 1 wherein the die holder is mounted releasably on a lower table of a press brake.

23. The press brake die holder of claim 1 wherein the channel is upwardly open and generally square or generally rectangular in cross section, and wherein the channel has a width that varies in response to movement of the locking bar toward or away from the die holder's second shoulder.

24. The press brake die holder of claim 1 wherein the locking bar has a long axis parallel to the die holder's channel, and wherein the die holder is configured such that said movement of the locking bar is lateral movement in a horizontal plane.

25. The press brake die holder of claim 1 wherein the locking bar has an upwardly-facing top surface, the die holder's first shoulder has an upwardly-facing top surface, and the die holder's second shoulder has an upwardly-facing top surface, all three of said upwardly-facing top surfaces lying substantially in a shared horizontal plane.

26. The press brake die holder of claim 25 wherein the locking bar has a downwardly-facing surface that slides against the die holder's base during clamping and unclamping actions of the die holder.

27. The press brake die holder of claim 1 wherein the locking bar defines a clamping wall that contacts the die's tang during a clamping action of the die holder, the clamping wall extending along substantially the entire length of the locking bar.

* * * * *